US010254672B2

(12) United States Patent
Ueda et al.

(10) Patent No.: US 10,254,672 B2
(45) Date of Patent: Apr. 9, 2019

(54) TONER FOR DEVELOPING ELECTROSTATIC CHARGE IMAGE

(71) Applicant: Konica Minolta, Inc., Tokyo (JP)

(72) Inventors: Noboru Ueda, Mitaka (JP); Shiro Hirano, Hachioji (JP)

(73) Assignee: KONICA MINOLTA, INC, Tokyo (JP)

( * ) Notice: Subject to any disclaimer, the term of this patent is extended or adjusted under 35 U.S.C. 154(b) by 0 days.

(21) Appl. No.: 15/051,226

(22) Filed: Feb. 23, 2016

(65) Prior Publication Data

US 2016/0259259 A1 Sep. 8, 2016

(30) Foreign Application Priority Data

Mar. 2, 2015 (JP) ..... 2015-040701

(51) Int. Cl.
*G03G 9/087* (2006.01)

(52) U.S. Cl.
CPC ..... *G03G 9/08786* (2013.01)

(58) Field of Classification Search
CPC ..... G03G 9/08786
See application file for complete search history.

(56) References Cited

U.S. PATENT DOCUMENTS

2011/0229816 A1* 9/2011 Shirai ..... G03G 9/08755 430/109.4
2014/0363763 A1* 12/2014 Shibata ..... G03G 9/08724 430/109.3

FOREIGN PATENT DOCUMENTS

| | | | |
|---|---|---|---|
| JP | 2011053494 | A | 3/2011 |
| JP | 2012226296 | A | 11/2012 |
| JP | 2012-255957 | * | 12/2012 |
| JP | 2012255957 | A | 12/2012 |
| JP | 2014074882 | A | 4/2014 |
| JP | 2014-235394 | A | 12/2014 |

OTHER PUBLICATIONS

Machine Translation of JP2012-255957, Parts A, B.*
Notification of Reasons for Refusal dated Mar. 7, 2017 from corresponding Japanese Patent Application No. JP 2015-040701; English translation of Notification of Reasons for Refusal; Total of 11 pages.

* cited by examiner

*Primary Examiner* — Thorl Chea
(74) *Attorney, Agent, or Firm* — Lucas & Mercanti, LLP

(57) ABSTRACT

Provided is a means to exhibit excellent low temperature fixability and to improve all of the heat-resistant storage property of a toner, charging uniformity, and transferability under a high temperature and high humidity condition.
A toner for developing electrostatic charge image which contains at least a binder resin, in which the binder resin has a core-shell structure having a core portion which contains a hybrid crystalline polyester resin formed by chemical bonds of a crystalline polyester resin unit with an amorphous resin unit other than a polyester resin and an amorphous resin and a shell portion which contains a hybrid amorphous polyester resin formed by chemical bonds of an amorphous polyester resin unit with an amorphous resin unit other than a polyester resin.

10 Claims, No Drawings

TONER FOR DEVELOPING ELECTROSTATIC CHARGE IMAGE

CROSS-REFERENCE TO RELATED APPLICATION

This application is based on Japanese Patent Application No. 2015-040701 filed on Mar. 2, 2015, the contents of which are incorporated herein by reference.

BACKGROUND

1. Technical Field

The present invention relates to a toner for developing electrostatic charge image.

2. Description of Related Art

In recent years, a decrease in thermal energy at the time of fixing a toner image has been desired for the purpose of increasing the printing speed, decreasing the environmental burden, and the like.

A technique is desired which can improve the low temperature fixability of the toner in order to decrease such thermal energy at the time of fixing the toner image, and as one of the means to achieve it, there is a method to use a crystalline resin exhibiting excellent sharp melting property such as a crystalline polyester in the binder resin. In addition, a toner for developing an electrostatic charge image, which contains a binder resin containing a crystalline polyester resin and an amorphous resin, is proposed as a toner exhibiting superior low temperature fixability. In this manner, it is possible to achieve low temperature fixation as the crystalline portion is melted when the temperature exceeds the melting point of the crystalline polyester by the temperature history at the time of fixing and the crystalline polyester resin and the amorphous resin are compatibilized with each other by using a mixture of a crystalline polyester resin and an amorphous resin.

For example, Japanese Patent Application Laid-Open No. 2012-226296 discloses an image forming method to use a toner for developing an electrostatic charge image which contains at least a binder resin containing a crystalline polyester and an amorphous polyester, a colorant, and a releasing agent is disclosed. In addition, Japanese Patent Application Laid-Open No. 2014-74882 discloses a toner containing at least a binder resin and a colorant, in which the binder resin contains a crystalline polyester resin (A), an amorphous resin (B), and a composite resin (C) containing a condensation polymerization-based resin unit and an addition polymerization-based resin unit. Furthermore, Japanese Patent Application Laid-Open No. 2012-255957 discloses a toner for developing an electrostatic charge image having a core-shell structure which has core particles formed to contain at least a binder resin and wax and a shell layer formed to coat the core particle, in which the binder resin contains at least a crystalline polyester resin and a styrene-acrylic resin. In addition, Japanese Patent Application Laid-Open No. 2011-53494 discloses a binder resin for electrophotographic toner, in which the binder resin is composed of a resin obtained by subjecting an aqueous dispersion containing a crystalline resin and an aqueous dispersion containing an amorphous resin to an aggregation step and a coalescence step and in which the crystalline resin is a composite resin containing a condensation polymerization-based resin component obtained through condensation polymerization of an alcohol component containing an aliphatic diol having from 2 to 10 carbon atoms and a carboxylic acid component and a styrene-based resin component.

SUMMARY

According to the techniques disclosed in Japanese Patent Application Laid-Open Nos. 2012-226296, 2014-74882, 2012-255957 and 2011-53494, a toner exhibiting favorable low temperature fixability is obtained. However, the image forming technique using a toner is desired not only to exhibit low temperature fixability but also to improve various properties such as the heat-resistant storage property of the toner, the charging uniformity, and the transferability under a high temperature and high humidity condition in a good balance, and techniques disclosed in Japanese Patent Application Laid-Open Nos. 2012-226296, 2014-74882, 2012-255957 and 2011-53494 do not satisfy all the above properties in a good balance.

Accordingly, an object of the invention is to provide a means to exhibit excellent low temperature fixability and to improve all of the heat-resistant storage property of the toner, the charging uniformity, and the transferability under a high temperature and high humidity condition.

The present inventors have carried out intensive studies. As a result, it has been found out that the above object can be achieved by a toner having a core-shell structure which contains a hybrid crystalline polyester resin formed by chemical bonds of a crystalline polyester resin unit with an amorphous resin unit other than a polyester resin in a core portion and a hybrid amorphous polyester resin formed by chemical bonds of an amorphous polyester resin unit with an amorphous resin unit other than a polyester resin in a shell portion, thereby completing the invention.

In other words, the above object is achieved by a toner for developing electrostatic charge image which contains at least a binder resin, in which the binder resin has a core-shell structure having a core portion which contains a hybrid crystalline polyester resin formed by chemical bonds of a crystalline polyester resin unit with an amorphous resin unit other than a polyester resin and an amorphous resin and a shell portion which contains a hybrid amorphous polyester resin formed by chemical bonds of an amorphous polyester resin unit with an amorphous resin unit other than a polyester resin.

According to the invention, it is possible to provide a means to exhibit excellent low temperature fixability and to improve all of the heat-resistant storage property of the toner, the charging uniformity, and the transferability under a high temperature and high humidity condition.

DETAILED DESCRIPTION

Hereinafter, embodiments of the invention will be described. Incidentally, the invention is not limited to the following embodiments. In addition, in the present specification, the term "X to Y" to indicate the range means "X or more and Y or less". In addition, the operations and the measurement of physical properties and the like are conducted under a condition of room temperature (20 to 25° C.)/relative humidity of from 40 to 50% unless otherwise stated.

An embodiment of the present invention is a toner for developing electrostatic charge image, including at least a binder resin, wherein the binder resin has a core-shell structure having a core portion which contains a hybrid crystalline polyester resin formed by chemical bonds of a crystalline polyester resin unit with an amorphous resin unit other than a polyester resin and an amorphous resin and a shell portion which contains a hybrid amorphous polyester resin formed by chemical bonds of an amorphous polyester resin unit with an amorphous resin unit other than a polyester resin.

In the present specification, the term "toner for developing an electrostatic charge image" is also simply referred to as the "toner" in some cases. In addition, in the present specification, the "hybrid crystalline polyester resin" is also simply referred to as the "hybrid crystalline resin" in some cases. Furthermore, in the present specification, the "hybrid amorphous polyester resin" is also simply referred to as the "hybrid amorphous resin" in some cases.

In the toner according to the invention, the binder resin constituting the toner has a core-shell structure, and the core portion contains a hybrid crystalline resin and an amorphous resin and the shell portion contains a hybrid amorphous resin as described above.

As described above, a crystalline polyester resin is effective in improving low temperature fixability of the toner, but the toner is plasticized when the crystalline polyester resin is combined with an amorphous resin and thus transferability under a high temperature and high humidity condition (hereinafter also referred to as HH transferability) or the heat-resistant storage property of the toner deteriorates in some cases. In such a case, it is effective to suppress the compatibilization of the crystalline polyester resin with the amorphous resin. However, the present inventors have newly found out a problem that particularly the charging uniformity is likely to decrease when the compatibilization is suppressed. A toner exhibiting low charging uniformity has a disadvantage that the concentration thereof is not constant and thus an image defect is caused at the time of forming an image.

As described above, there is a trade-off relation in the toner containing a crystalline polyester resin and an amorphous resin that sufficient charging uniformity is not obtained when the compatibilization of the crystalline polyester resin is suppressed in order to obtain favorable heat-resistant storage property or HH transferability, and thus it is difficult to improve all the physical properties in a good balance.

With regard to such a phenomenon, the present inventors have considered that the crystalline polyester resin is hardly incorporated into the amorphous resin as the compatibilization of the crystalline polyester resin with the amorphous resin is suppressed and thus the charging property of the toner is deteriorated by the crystalline polyester resin exposed on the toner surface and the image defect is caused. Moreover, it is considered that it is possible to suppress the exposure of the crystalline polyester resin on the toner surface by controlling the compatible state of the shell portion with the core portion as the amorphous polyester resin contained in the shell portion is hybridized as well as the crystalline polyester resin contained in the core portion is hybridized, and thus it is possible to achieve the above object, thereby completing the invention.

In a case in which the binder resin contains a crystalline polyester resin and an amorphous resin as in Japanese Patent Application Laid-Open No. 2012-226296, the affinity of these resins for each other is low and the crystalline polyester resin is likely to be exposed on the binder resin surface. Moreover, it is presumed that the charging property of the binder resin is deteriorated for the reason that the crystalline polyester resin itself is hardly charged or has a low ability of maintaining the charge.

On the other hand, the toner of the invention contains a hybrid crystalline resin formed by chemical bonds of a crystalline polyester resin unit with an amorphous resin unit other than a polyester resin in the core portion. This hybrid crystalline resin has an amorphous resin unit other than polyester resin in addition to the crystalline polyester resin unit and thus it exhibits favorable affinity for the amorphous resin contained in the core portion. Hence, the crystalline polyester resin unit in the hybrid crystalline resin is easily familiar for the amorphous resin constituting the core portion, and as a result, the crystalline polyester resin unit is more likely to exist in the core portion but hardly exposed on the toner surface, whereby the charging uniformity is improved.

The following (1), (2), and the like are considered as the factors to decrease the charging uniformity in addition to the above. (1) The dispersibility of the crystalline polyester resin in the amorphous resin is poor and (2) the crystalline polyester resin in the core portion and the amorphous polyester resin in the shell portion come in contact with each other to form a conductive path. On the contrary to such a phenomenon, it is considered that a conduction path is hardly formed by the hybrid crystalline resin and the hybrid amorphous resin in the shell portion and thus the charging uniformity is further improved in the toner of the invention in which the hybrid crystalline resin is likely to be finely dispersed in the center of the core portion.

In addition, in the case of using a vinyl resin as the amorphous resin of the core portion, the vinyl resin is usually incompatible with the amorphous polyester resin used in the shell portion and it is difficult to form a uniform shell portion on the surface of the core portion. However, the binder resin according to the invention contains a hybrid amorphous resin in the shell portion, and thus partial compatibilization proceeds at the interface between the shell portion and the core portion and it is possible to form a more uniform shell portion on the surface of the core portion while the binder resin is incompatible as a whole. Consequently, the toner of the invention can exhibit improved heat-resistant storage property while exhibiting excellent low temperature fixability.

In addition, the reason for the improved HH transferability of the toner of the invention is considered as follows. The goodness or badness of HH transferability is determined by the dispersion state of the colorant in the toner. The HH transferability is favorable when the colorant is finely dispersed but the HH transferability deteriorates when the dispersed state of the colorant is poor due to the reason that the colorant exists as an aggregate in the toner. In the case of using a vinyl resin as an amorphous resin of the core portion, the affinity of the vinyl resin for the crystalline polyester resin is higher as compared with the case of using an amorphous polyester resin that is also amorphous, and thus the crystalline polyester resin in the vinyl resin can be present in a finely dispersed state. Furthermore, it is considered that the crystalline polyester resin according to the invention is partly hybridized with an amorphous resin other than a polyester resin, thus the affinity of the crystalline polyester resin for the vinyl resin further increases and the dispersibility is improved, which leads to the improvement in HH transferability.

It is difficult to improve the heat-resistant storage property, charging uniformity, and HH transferability in a good balance together with the low temperature fixability in the toner of the prior art using a binder resin in which the compatibilization of the crystalline polyester resin with the amorphous resin is suppressed. However, as described above, the invention has a hybrid crystalline resin obtained by hybridizing a crystalline polyester resin and an amorphous resin in the core portion of the binder resin and a hybrid amorphous resin obtained by hybridizing an amorphous polyester resin in the shell portion of the binder resin. The toner of the invention having such a structure becomes one in which the charging uniformity, heat-resistant storage property, and HH transferability are all improved while favorable low temperature fixability is maintained.

Incidentally, the above mechanism is based on presumption, and the invention is not limited to the above mechanism in any way.

Hereinafter, the invention will be described in detail.

<Binder Resin>

The binder resin constituting the toner according to the invention has a core-shell structure and contains a hybrid crystalline polyester resin (hybrid crystalline resin) to be described in detail below and an amorphous resin in the core portion and a hybrid amorphous polyester resin (hybrid amorphous resin) in the shell portion.

(Hybrid Crystalline Polyester Resin (Hybrid Crystalline Resin))

The hybrid crystalline polyester resin (hybrid crystalline resin) is a resin in which a crystalline polyester resin unit is chemically bonded to an amorphous resin unit other than a polyester resin.

In the above, the crystalline polyester resin unit refers to a moiety that is derived from a crystalline polyester resin. In other words, it refers to a molecular chain having the same chemical structure as that which constitutes the crystalline polyester resin. In addition, the amorphous resin unit other than a polyester resin refers to a moiety that is derived from an amorphous resin other than polyester. In other words, it refers to a molecular chain having the same chemical structure as that which constitutes the amorphous resin other than a polyester resin.

<<Crystalline Polyester Resin Unit>>

The crystalline polyester resin unit is a moiety that is derived from a known polyester resin obtained by the polycondensation reaction of a divalent or higher carboxylic acid (polycarboxylic acid component) and a dihydric or higher alcohol (polyhydric alcohol component) and is a resin unit which has not a stepwise endothermic change but has a clear endothermic peak in the differential scanning calorimetry (DSC) of the toner. The clear endothermic peak specifically means a peak in which the half width of the endothermic peak is within 15° C. when measured at a temperature raising rate of 10° C./min in the differential scanning calorimetry (DSC) described in Examples.

The crystalline polyester resin unit is not particularly limited as long as it is as defined above. For example, a resin having a structure in which another component is copolymerized to the main chain composed of a crystalline polyester resin unit or a resin having a structure in which a crystalline polyester resin unit is copolymerized to the main chain composed of another component corresponds to a hybrid crystalline resin having a crystalline polyester resin unit of the invention when a toner containing this resin has a clear endothermic peak as described above.

In addition, the valence of the polycarboxylic acid component and the polyhydric alcohol component is preferably from 2 to 3 and even more preferably 2, respectively, and thus a case in which the valence of them is 2, respectively (namely, a dicarboxylic acid component and a diol component) will be described as a particularly preferred form.

It is preferable to use an aliphatic dicarboxylic acid and an aromatic dicarboxylic acid may be used concurrently as the dicarboxylic acid component. It is preferable to use straight chain type ones as the aliphatic dicarboxylic acid. There is an advantage that crystallinity is improved as straight chain type ones are used. The dicarboxylic acid component may be used singly or as a mixture of two or more kinds thereof.

Examples of the aliphatic dicarboxylic acid may include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid (dodecanedioic acid), 1,13-tridecanedicarboxylic acid, 1,14-tetradecanedicarboxylic acid (tetradecanedioic acid), 1,16-hexadecanedicarboxylic acid, and 1,18-octadecanedicarboxylic acid, and any lower alkyl ester or any acid anhydride thereof can also be used.

Among the aliphatic dicarboxylic acids, the dicarboxylic acid component is preferably an aliphatic dicarboxylic acid having from 6 to 14 carbon atoms from the viewpoint of easily obtaining the effect of the invention as described above.

Examples of the aromatic dicarboxylic acid that can be used together with the aliphatic dicarboxylic acid may include terephthalic acid, isophthalic acid, orthophthalic acid, t-butylisophthalic acid, 2,6-naphthalenedicarboxylic acid, and 4,4'-biphenyldicarboxylic acid. Among these, it is preferable to use terephthalic acid, isophthalic acid, and t-butylisophthalic acid from the viewpoint of being easily available and easily emulsified.

As the dicarboxylic acid component for forming the crystalline polyester resin unit, the content of the aliphatic dicarboxylic acid is preferably 50% by constituting mole or more, more preferably 70% by constituting mole or more, even more preferably 80% by constituting mole or more, and even more preferably 100% by constituting mole. It is possible to sufficiently secure the crystallinity of the crystalline polyester resin unit by setting the content of the aliphatic dicarboxylic acid in the dicarboxylic acid component to 50% by constituting mole or more.

In addition, as the diol component, it is preferable to use an aliphatic diol and a diol other than the aliphatic diol or a polyhydric alcohol may be contained if necessary. It is preferable to use straight chain type ones as the aliphatic diol. There is an advantage that crystallinity is improved as straight chain type ones are used. The diol component may be used singly or as a mixture of two or more kinds thereof.

Examples of the aliphatic diol may include ethylene glycol, 1,2-propanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol.

Among aliphatic diols, the diol component is preferably an aliphatic diol having from 2 to 14 carbon atoms and more preferably an aliphatic diol having from 4 to 14 carbon atoms from the viewpoint of easily obtaining the effect of the invention as described above.

Examples of the diol other than the aliphatic diol or the polyhydric alcohol used if necessary may include a diol having a double bond and a trihydric or higher polyhydric alcohol. Specific examples of the diol having a double bond may include 2-butene-1,4-diol, 3-butene-1,6-diol, and 4-butene-1,8-diol. In addition, examples of trihydric or higher polyhydric alcohol may include glycerin, pentaerythritol, trimethylolpropane, and sorbitol.

As the diol component for forming the crystalline polyester resin unit, the content of the aliphatic diol is preferably 50% by constituting mole or more, more preferably 70% by constituting mole or more, even more preferably 80% by constituting mole or more, and even more preferably 100% by constituting mole. It is possible to secure the crystallinity of the crystalline polyester resin unit by setting the content of the aliphatic diol in the diol component to 50% by constituting mole or more, and thus excellent low temperature fixability is imparted to the toner to be finally obtained.

The ratio of the diol component to the dicarboxylic acid component used is set to preferably from 1.5/1 to 1/1.5 and more preferably from 1.2/1 to 1/1.2 in the equivalence ratio [OH]/[COOH] of the hydroxyl group [OH] in the diol component to the carboxyl group [COOH] in the dicarboxylic acid component. It is easier to control the acid value and molecular weight of the crystalline polyester as the ratio of the diol component to the dicarboxylic acid component used is in the above range.

The method for forming the crystalline polyester resin unit is not particularly limited, and it is possible to form the unit through the polycondensation (esterification) of the dicarboxylic acid component with the diol component utilizing a known esterification catalyst.

Examples of the catalyst which can be used in the production of the crystalline polyester resin unit may include a compound of an alkali metal such as sodium or lithium; a compound containing a group 2 element such as magnesium or calcium; a compound of a metal such as aluminum, zinc, manganese, antimony, titanium, tin, zirconium, or germanium; a phosphorous acid compound; a phosphoric acid compound; and an amine compound. Specifically, examples of the tin compound may include dibutyltin oxide, tin octylate, tin dioctoate, and any salt thereof. Examples of the titanium compound may include a titanium alkoxide such as tetra-n-butyl titanate, tetraisopropyl titanate, tetramethyl titanate, or tetrastearyltitanate; a titanium acylate such as polyhydroxy titanium stearate; and a titanium chelate such as titanium tetraacetylacetonate, titanium lactate, or titanium triethanolaminate. Examples of the germanium compound may include germanium dioxide. Furthermore, examples of the aluminum compound may include an oxide such as polyaluminum hydroxide, an aluminum alkoxide, and tributyl aluminate. These may be used singly or in combination of two or more kinds thereof.

The polymerization temperature is not particularly limited, but it is preferably from 150 to 250° C. In addition, the polymerization time is not particularly limited, but it is preferably from 0.5 to 10 hours. It is also possible to reduce the internal pressure of the reaction system during the polymerization if necessary.

The content of the crystalline polyester resin unit in the hybrid crystalline resin is preferably from 50 to 99.9% by mass, more preferably from 70 to 95% by mass, and even more preferably 80 to 95% by mass with respect to the total amount of the hybrid crystalline resin. As the content is set to be in the above range, it is possible to impart sufficient crystallinity to the hybrid crystalline resin and also the toner to be finally obtained becomes one in which the charging uniformity, heat-resistant storage property, and HH transferability are all improved while favorable low temperature fixability is maintained. Incidentally, the constitutional component and proportion of each unit in the hybrid crystalline resin can be identified, for example, through the NMR measurement and the P-GC/MS measurement using a methylation reaction.

The hybrid crystalline resin contains the amorphous resin unit other than a polyester resin to be described in detail below in addition to the crystalline polyester resin unit. The hybrid crystalline resin may be in any form of a block copolymer, a graft copolymer, or the like as long as it contains the crystalline polyester resin unit described above and an amorphous resin unit other than a polyester resin, but it is preferably a graft copolymer. As the hybrid crystalline resin is a graft copolymer, it is easy to control the orientation of the crystalline polyester resin unit and it is possible to impart sufficient crystallinity to the hybrid crystalline resin, and thus the toner to be finally obtained becomes one in which the charging uniformity, heat-resistant storage property, and HH transferability are all improved while favorable low temperature fixability is maintained.

Furthermore, it is preferable that the hybrid crystalline resin has a structure in which the crystalline polyester resin unit is grafted to the amorphous resin unit other than the crystalline polyester resin as the main chain from the above viewpoint. In other words, the hybrid crystalline polyester resin is preferably a graft copolymer which has the amorphous resin unit other than a polyester resin as the main chain and the crystalline polyester resin unit as the side chain. By having such a form, it is possible to further enhance the orientation of the crystalline polyester resin unit and to improve the crystallinity of the hybrid crystalline resin, and thus the toner to be finally obtained becomes one in which the charging uniformity, heat-resistant storage property, and HH transferability are all improved while favorable low temperature fixability is maintained.

Incidentally, a substituent such as a sulfonic acid group, a carboxyl group, and a urethane group may be further introduced into the hybrid crystalline resin. The substituent may be introduced into the crystalline polyester resin unit or the amorphous resin unit other than a polyester resin to be described in detail below.

<<Amorphous Resin Unit Other than Polyester Resin>>

The amorphous resin unit other than a polyester resin (in the present specification, also simply referred to as the "amorphous resin unit" in some cases) is an essential unit for controlling the affinity of the amorphous resin for the hybrid crystalline resin which constitute the core portion of the binder resin. As the amorphous resin unit is present, the affinity of the hybrid crystalline resin for the amorphous resin in the core portion is improved, the hybrid crystalline resin is easily incorporated into the amorphous resin, and it is possible to improve the charging uniformity.

The amorphous resin unit is a moiety that is derived from an amorphous resin other than the crystalline polyester resin. It is possible to confirm the fact that the amorphous resin unit is contained in the hybrid crystalline resin (further, in the toner), for example, by identifying the chemical structure through the NMR measurement and the P-GC/MS measurement using a methylation reaction.

In addition, the amorphous resin unit is a resin unit which does not have a melting point but has a relatively high glass transition temperature (Tg) when a resin having the same chemical structure and molecular weight as those of the unit is subjected to the differential scanning calorimetry (DSC). At this time, the glass transition temperature (Tg) of the resin having the same chemical structure and molecular weight as those of the unit is preferably from 30 to 70° C. and even more preferably from 35 to 65° C.

The amorphous resin unit is not particularly limited as long as it is as defined above. For example, a resin having a structure in which another component is copolymerized to the main chain composed of an amorphous resin unit or a resin having a structure in which an amorphous resin unit is copolymerized to the main chain composed of another component corresponds to a hybrid crystalline resin having an amorphous resin unit of the invention when a toner containing this resin is one which has the amorphous resin unit as described above.

It is preferable that the amorphous resin unit is constituted by the same kind of resin as the amorphous resin contained in the core portion of the binder resin (namely, a resin contained in the core portion other than the hybrid crystalline resin). By having such a form, the affinity of the hybrid crystalline resin for the amorphous resin is further improved, the hybrid crystalline resin is more easily incorporated into the amorphous resin, and the charging uniformity and the like are further improved.

Here, the "same kind of resin" means that a characteristic chemical bond is contained in the repeating units in common. Here, the "characteristic chemical bond" follows the "polymer classification" described in the Materials database of the National Institute for Materials Science (NIMS) (http://polymer.nims.go.jp/PoLyInfo/guide/jp/term_polymer.html). In other words, the chemical bonds that form polymers which are classified into 22 kinds of polyacryl, polyamide, polyanhydride, polycarbonate, polydiene, polyester, polyhalo-olefin, polyimide, polyimine, polyketone, polyolefin, polyether, polyphenylene, polyphosphazene, polysiloxane, polystyrene, polysulfide, polysulfone, polyurethane, polyurea, polyvinyl, and other polymers in total are referred to as the "characteristic chemical bonds".

In addition, the "same kind of resin" in a case in which the resin is a copolymer refers to the resins which have a characteristic chemical bond in common in a case in which a monomer species having the chemical bond is set as the constitutional unit in the chemical structures of a plurality of monomer species constituting the copolymer. Consequently, the resins are regarded as the same kind of resin as long as they have a characteristic chemical bond in common even in a case in which the resins themselves have different properties from each other or a case in which the molar component ratio of the monomer species constituting the copolymer are different from each other.

For example, a resin (or a resin unit) formed by styrene, butyl acrylate, and acrylic acid and a resin (or a resin unit) formed by styrene, butyl acrylate, and methacrylic acid have at least the chemical bond constituting polyacryl, and thus these are the same kind of resin. For another example, a resin (or a resin unit) formed by styrene, butyl acrylate, and acrylic acid and a resin (or a resin unit) formed by styrene, butyl acrylate, acrylic acid, terephthalic acid, and fumaric acid have at least the chemical bond constituting polyacryl as the chemical bond which they have in common. Hence, these are the same kind of resin.

The resin component constituting the amorphous resin unit is not particularly limited, but examples thereof may include a vinyl resin unit, a urethane resin unit, and a urea resin unit. Among these, a vinyl resin unit is preferable for the reason that the thermoplasticity is easily controlled.

The vinyl resin unit is not particularly limited as long as it is one obtained by polymerizing a vinyl compound, but examples thereof may include an acrylic acid ester resin unit, a styrene-acrylic acid ester resin unit, and an ethylene-vinyl acetate resin unit. These may be used singly or in combination of two or more kinds thereof.

Among the vinyl resin units, a styrene-acrylic acid ester resin unit (styrene-acrylic resin unit) is preferable in consideration of the plasticity at the time of heat fixing. Hence, the styrene-acrylic resin unit as the amorphous resin unit will be described below.

The styrene-acrylic resin unit is one that is formed through the addition polymerization of at least a styrene monomer and a (meth)acrylic acid ester monomer. The styrene monomer as referred to herein includes those which have a structure having a known side-chain or functional group in the styrene structure in addition to styrene represented by Structural Formula of $CH_2{=}CH{-}C_6H_5$. In addition, the (meth)acrylic acid ester monomer as referred to herein includes those which have a known side-chain or functional group in the structure of an acrylic acid ester derivative, a methacrylic acid ester derivative, or the like in addition to an acrylic acid ester compound or a methacrylic acid ester compound represented by $CH_2{=}CHCOOR$ (R is an alkyl group).

Specific examples of the styrene monomer and the (meth) acrylic acid ester monomer which can be used in the formation of the styrene-acrylic resin unit are mentioned below, but those that can be used in the formation of the styrene-acrylic resin unit to be used in the invention are not limited to those mentioned below.

First, specific examples of the styrene monomer may include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These styrene monomers may be used singly or in combination of two or more kinds thereof.

In addition, specific examples of the (meth)acrylic acid ester monomer may include an acrylic acid ester monomer such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, or phenyl acrylate; and a methacrylic acid ester such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate.

Incidentally, in the present specification, the term "(meth) acrylic acid ester monomer" is a general term for the "acrylic acid ester monomer" and the "methacrylic acid ester monomer", and for example, "methyl(meth)acrylate" is a general term for "acrylic acid methyl ester (methyl acrylate)" and "methacrylic acid methyl ester (methyl methacrylate)".

These acrylic acid ester monomers or methacrylic acid ester monomers may be used singly or in combination of two or more kinds thereof. In other words, it is possible to form a copolymer by using a styrene monomer and two or more kinds of acrylic acid ester monomers, to form a copolymer by using a styrene monomer and two or more kinds of methacrylic acid ester monomers, or to form a copolymer by concurrently using a styrene monomer, an acrylic acid ester monomer and a methacrylic acid ester monomer.

The content of the constitutional unit derived from a styrene monomer in the amorphous resin unit is preferably from 60 to 85% by mass with respect to the total amount of the amorphous resin unit. In addition, the content of the constitutional unit derived from a (meth)acrylic acid ester monomer in the amorphous resin unit is preferably from 10 to 35% by mass with respect to the total amount of the amorphous resin unit. It is easy to control the plasticity of the hybrid crystalline resin by setting the contents to be in such ranges.

Furthermore, it is preferable that the amorphous resin unit is formed through the addition polymerization of a compound for being chemically bonded to the crystalline polyester resin unit as well in addition to the styrene monomer and the (meth)acrylic acid ester monomer. Specifically, it is preferable to use a compound which forms an ester bond with the hydroxyl group [—OH] derived from a polyhydric alcohol or the carboxyl group [—COOH] derived from a polycarboxylic acid contained in the crystalline polyester resin unit. Hence, it is preferable that the amorphous resin unit is formed by further polymerizing a compound which is capable of being addition-polymerized to the styrene monomer and the (meth)acrylic acid ester monomer and has a carboxyl group [—COOH] or a hydroxyl group [—OH].

Examples of such a compound may include a compound having a carboxyl group such as an acrylic acid, methacrylic acid, maleic acid, itaconic acid, cinnamic acid, fumaric acid, maleicacidmonoalkyl ester, or itaconic acid monoalkyl ester; and a compound having a hydroxyl group such as 2-hydroxyethyl(meth)acrylate, 2-hydroxypropyl(meth)acrylate, 3-hydroxypropyl(meth)acrylate, 2-hydroxybutyl(meth)acrylate, 3-hydroxybutyl(meth)acrylate, 4-hydroxybutyl(meth)acrylate, or polyethylene glycol mono(meth)acrylate.

The content of the constitutional unit derived from the compound in the amorphous resin unit is preferably from 0.1 to 15% by mass with respect to the total amount of the amorphous resin unit.

The method for forming the styrene-acrylic resin unit is not particularly limited, and examples thereof may include a method in which the monomers are polymerized using a known oil-soluble or water-soluble polymerization initiator. As the oil-soluble polymerization initiator, specifically, there are azo-based or diazo-based polymerization initiators or peroxide-based polymerization initiators to be described below.

Examples of the azo-based or diazo-based polymerization initiator may include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

Examples of the peroxide-based polymerization initiator may include benzoyl peroxide, methylethyl ketone peroxide, diisopropyl peroxy carbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, and tris-(t-butylperoxy)triazine.

In addition, it is possible to use a water-soluble radical polymerization initiator in the case of forming the resin particles by emulsion polymerization. Examples of the water-soluble polymerization initiator may include a persulfuric acid salt such as potassium persulfate or ammonium persulfate, any azobisaminodipropane acetic acid salt, azobiscyanovaleric acid and any salt thereof, and hydrogen peroxide.

The content of the amorphous resin unit in the hybrid crystalline resin is preferably from 0.1 to 50% by mass, more preferably from 5 to 30% by mass, and even more preferably 5 to 20% by mass with respect to the total amount of the hybrid crystalline resin. It is possible to impart sufficient crystallinity to the hybrid crystalline resin by setting the content to be in the above range.

<<Method for Producing Hybrid Crystalline Polyester Resin (Hybrid Crystalline Resin)>>

The method for producing the hybrid crystalline polyester resin contained in the binder resin according to the invention is not particularly limited as long as it is a method capable of forming a polymer having a structure in which the crystalline polyester resin unit and the amorphous resin unit are bonded to each other through molecular bonds. Examples of the specific method for producing the hybrid crystalline resin may include the methods to be described below.

(1) A method for producing the hybrid crystalline resin in which the amorphous resin unit is polymerized in advance and the crystalline polyester resin unit is formed by conducting a polymerization reaction in the presence of the amorphous resin unit In this method, first, the amorphous resin unit is formed by subjecting a monomer (preferably vinyl monomers such as a styrene monomer and a (meth)acrylic acid ester monomer) constituting the amorphous resin unit described above to the addition reaction. Next, the crystalline polyester resin unit is formed by subjecting the polycarboxylic acid component and the polyhydric alcohol component to a polymerization reaction in the presence of the amorphous resin unit. At this time, the hybrid crystalline resin is formed by subjecting the polycarboxylic acid and the polyhydric alcohol to the condensation reaction as well as subjecting the polycarboxylic acid or the polyhydric alcohol to the addition reaction to the amorphous resin unit.

In the above method, it is preferable that a moiety through which these units can react with each other is incorporated into the crystalline polyester resin unit or the amorphous resin unit. Specifically, a compound which has a moiety capable of reacting with the carboxyl group [—COOH] or hydroxyl group [—OH] remaining in the crystalline polyester resin unit and a moiety capable of reacting with the amorphous resin unit is used in addition to the monomer constituting the amorphous resin unit when forming the amorphous resin unit. In other words, the crystalline polyester resin unit can be chemically bonded to the amorphous resin unit as this compound reacts with the carboxyl group [—COOH] or hydroxyl group [—OH] in the crystalline polyester resin unit.

Alternatively, a compound which has a moiety capable of reacting with the polyhydric alcohol component or the polycarboxylic acid component and a moiety capable of reacting with the amorphous resin unit may be used when forming the crystalline polyester resin unit.

It is possible to form the hybrid crystalline resin having a structure (graft structure) in which the crystalline polyester resin unit is bonded to the amorphous resin unit through molecular bonds by using the above method.

(2) A method for producing the hybrid crystalline resin in which the crystalline polyester resin unit and the amorphous resin unit are formed, respectively, and these are bonded to each other In this method, first, the crystalline polyester resin unit is formed by subjecting the polycarboxylic acid component and the polyhydric alcohol component to the condensation reaction. In addition, the amorphous resin unit is formed by subjecting the monomer constituting the amorphous resin unit described above to the addition polymerization separately from the reaction system to form the crystalline polyester resin unit. At this time, it is preferable that a moiety through which the crystalline polyester resin unit and the amorphous resin unit can react with each other is incorporated thereinto. Incidentally, the method for incorporating such a moiety capable of reacting is as described above, and thus the detailed description thereof is omitted.

Next, it is possible to form the hybrid crystalline resin having a structure in which the crystalline polyester resin unit is bonded to the amorphous resin unit through molecular bonds by allowing the crystalline polyester unit and the amorphous resin unit which are formed above to react with each other.

In addition, in a case in which the moiety capable of reacting is not incorporated into the crystalline polyester resin unit and the amorphous resin unit, it is also possible to employ a method in which a system in which the crystalline polyester resin unit and the amorphous resin unit coexist is formed and a compound which has a moiety capable of bonding to the crystalline polyester resin unit and the amorphous resin unit is introduced to the system. Thereafter, it is possible to form the hybrid crystalline resin having a structure in which the crystalline polyester resin unit is bonded to the amorphous resin unit through molecular bonds via the compound.

(3) A method for producing the hybrid crystalline resin in which the crystalline polyester resin unit is formed in advance and the amorphous resin unit is formed by conducting a polymerization reaction in the presence of the crystalline polyester resin unit In this method, first, the crystalline polyester resin unit is formed by subjecting the polycarboxylic acid component and the polyhydric alcohol component to the condensation reaction to be polymerized. Next, the amorphous resin unit is formed by subjecting the monomer constituting the amorphous resin unit to a polymerization reaction in the presence of the crystalline polyester resin unit. At this time, it is preferable that a moiety through which these units can react with each other is incorporated into the crystalline polyester resin unit or the amorphous resin unit in the same manner as in (1) above. Incidentally, the method for incorporating such a moiety capable of reacting is as described above, and thus the detailed description thereof is omitted.

It is possible to form the hybrid crystalline resin having a structure (graft structure) in which the crystalline polyester resin unit is bonded to the amorphous resin unit through molecular bonds by using the above method.

Among the forming methods of (1) to (3) above, the method of (1) is preferable since it is easy to form the hybrid crystalline resin having a structure in which the crystalline polyester resin chain is grafted to the amorphous resin chain or it is possible to simplify the production process. In the method of (1), the amorphous resin unit is formed in advance and the crystalline polyester resin unit is then bonded thereto, and thus the orientation of the crystalline polyester resin unit is likely to be uniform. Hence, the method of (1) is preferable since it is possible to reliably form the hybrid crystalline resin suitable for the toner defined in the invention.

The weight average molecular weight (Mw) of the hybrid crystalline resin is preferably from 5,000 to 60,000 and more preferably from 10,000 to 40,000 from the viewpoint of securing the low temperature fixability. The weight average molecular weight can be measured by the method described in Examples.

(Amorphous Resin)

The amorphous resin constitutes the core portion of the binder resin together with the hybrid crystalline resin. The amorphous resin is not particularly limited, but it is a resin which does not have a melting point but has a relatively high glass transition temperature (Tg) when the resin is subjected to the differential scanning calorimetry (DSC). At this time, the glass transition temperature (Tg) of the resin is preferably from 30 to 70° C. and even more preferably from 35 to 65° C.

It is preferable that the amorphous resin contains the resin component constituting the unit described in the section of <<amorphous resin unit other than polyester resin>> above. In other words, it is preferable that the amorphous resin is a vinyl resin, a urethane resin, a urea resin, and the like. Furthermore, the amorphous resin may be an amorphous polyester resin such as a styrene-acrylic-modified polyester resin.

It is preferable that the amorphous resin contained in the core portion is constituted by the same kind of resin as the amorphous resin unit in the hybrid crystalline resin. Here, the phrase "constituted by the same kind of resin" means that it may have a form that is composed of only the same kind of resin or a form that is not composed of only the same kind of resin but contains another amorphous resin. However, in the case of the form which contains the same kind of resin and another amorphous resin, the content of the same kind of resin is preferably 15% by mass or more and more preferably 20% by mass or more with respect to the total amount of the amorphous resin.

Furthermore, the amorphous resin may be a copolymer which has a unit derived from the same kind of resin as the amorphous resin unit in the hybrid crystalline resin and a unit derived from another amorphous resin. At this time, the copolymer may be any of a block copolymer, a graft copolymer, or the like, but it is preferably a graft copolymer from the viewpoint of easily controlling the compatibility with the hybrid crystalline resin. However, in this case, the content of the unit derived from the same kind of resin as the amorphous resin unit in the hybrid crystalline resin is preferably 15% by mass or more and more preferably 20% by mass or more with respect to the total amount of the amorphous resin.

Incidentally, the definition of the "same kind of resin" is described in the section of <<amorphous resin unit other than polyester resin>> above, and thus the detailed description thereof is omitted.

The resin used as the amorphous resin contained in the core portion is preferably a vinyl resin among the above resins. The vinyl resin is suitable from the viewpoint of easily controlling the compatibility with the hybrid crystalline resin particularly in a case in which the amorphous resin unit in the hybrid crystalline resin is a vinyl resin unit.

Accordingly, the vinyl resin will be described below.

<<Vinyl Resin>>

In the case of using a vinyl resin as the amorphous resin, the vinyl resin is not particularly limited as long as it is obtained by polymerizing a vinyl compound, but examples thereof may include an acrylic acid ester resin, a styrene-acrylic acid ester resin, and an ethylene-vinyl acetate resin. These may be used singly or in combination of two or more kinds thereof.

Among the above vinyl resins, a styrene-acrylic acid ester resin (styrene-acrylic resin) is preferable in consideration of the plasticity at the time of heat fixing. As the monomer constituting the styrene-acrylic resin, it is possible to use the same ones as the compounds mentioned as the monomer constituting the styrene-acrylic resin unit in the section of <<amorphous resin unit other than polyester resin>> above.

Hence, the detailed description thereof is omitted, but it is preferable to use styrene, o-methylstyrene, m-methylstyrene, p-methylstyrene, α-methylstyrene, p-phenylstyrene, or p-ethylstyrene as the styrene monomer; and an acrylic acid ester monomer such as methyl acrylate, ethyl acrylate, isopropyl acrylate, n-butyl acrylate, or isobutyl acrylate; and a methacrylic acid ester such as methyl methacrylate, ethyl methacrylate, n-butyl methacrylate, isopropyl methacrylate, or isobutyl methacrylate as the (meth)acrylic acid ester monomer. These styrene monomers and (meth)acrylic acid ester monomers may be used singly or in combination of two or more kinds thereof.

In addition, another monomer may be polymerized, and examples thereof may include acrylic acid, methacrylic acid, maleic acid, itaconic acid, cinnamic acid, fumaric acid, a maleic acid monoalkyl ester, an itaconic acid monoalkyl ester, 2-hydroxyethyl(meth)acrylate, 2-hydroxypropyl (meth)acrylate, 3-hydroxypropyl(meth)acrylate, 2-hydroxybutyl(meth)acrylate, 3-hydroxybutyl(meth)acrylate, 4-hydroxybutyl(meth)acrylate, and polyethylene glycol mono (meth)acrylate.

The content of the constitutional unit derived from the styrene monomer in the styrene-acrylic resin is preferably from 60 to 85% by mass with respect to the total amount of the styrene-acrylic resin. The content of the constitutional unit derived from the (meth)acrylic acid ester monomer in the styrene-acrylic resin is preferably from 10 to 35% by mass with respect to the total amount of the styrene-acrylic resin. It is easy to control the plasticity of the amorphous resin by setting the contents to be in such ranges.

The content of the constitutional unit derived from the other monomer in the styrene-acrylic resin is preferably from 0.1 to 15% by mass with respect to the total amount of the styrene-acrylic resin.

The method for producing the styrene-acrylic resin is not particularly limited, and the styrene-acrylic resin can be produced by the same method as the method for forming the styrene-acrylic resin unit that is described in the section of <<amorphous resin unit other than polyester resin>> above.

Incidentally, the core portion of the binder resin may contain a resin other than the hybrid crystalline resin and the amorphous resin, but it is preferable that the core portion is composed of the hybrid crystalline resin and the amorphous resin.

The weight average molecular weight (Mw) of the amorphous resin is preferably from 10,000 to 100,000 and more preferably from 20,000 to 90,000 from the viewpoint of securing the low temperature fixability.

(Form of Core Portion of Binder Resin)

The form (form of resin particles) of the core portion of the binder resin contained in the toner of the invention may be any one as long as the core portion contains the hybrid crystalline resin and the amorphous resin.

For example, the resin particles of the core portion may be one having a so-called single-layer structure or one having a multilayer structure.

(Hybrid Amorphous Polyester Resin (Hybrid Amorphous Resin))

The hybrid amorphous polyester resin (hybrid amorphous resin) contained in the shell portion of the binder resin of the invention is a resin formed by a chemical bond of an amorphous polyester resin unit with an amorphous resin unit other than a polyester resin.

In the above, the amorphous polyester resin unit refers to a moiety that is derived from an amorphous polyester resin. In other words, it refers to a molecular chain having the same chemical structure as that which constitutes the amorphous polyester resin. In addition, the amorphous resin unit other than a polyester resin refers to a moiety that is derived from an amorphous resin other than a polyester resin. In other words, it refers to a molecular chain having the same chemical structure as that which constitutes the amorphous resin other than a polyester resin.

<<Amorphous Polyester Resin Unit>>

The amorphous polyester resin unit is a moiety that is derived from a known polyester resin obtained by polycondensation reaction of a divalent or higher carboxylic acid (polycarboxylic acid component) with a dihydric or higher alcohol (polyhydric alcohol component), and it refers to a resin unit which does not have a clear endothermic peak in the differential scanning calorimetry (DSC) of the toner. The clear endothermic peak is as described in the section of <<crystalline polyester resin unit>> above.

The amorphous polyester resin unit is not particularly limited as long as it is as defined above. For example, a resin having a structure in which another component is copolymerized to the main chain composed of an amorphous polyester resin unit or a resin having a structure in which an amorphous polyester resin unit is copolymerized to the main chain composed of another component corresponds to a hybrid amorphous resin having an amorphous polyester resin unit of the invention when a toner containing this resin does not have a clear endothermic peak as described above.

Examples of the polycarboxylic acid component may include dicarboxylic acids such as oxalic acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and dodecenylsuccinic acid; trimellitic acid, pyromellitic acid, naphthalenetricarboxylic acid, naphthalenetetracarboxylic acid, pyrenetricarboxylic acid, and pyrenetetracarboxylic acid. These polycarboxylic acids may be used singly or as a mixture of two or more kinds thereof.

Among these, it is preferable to use an aliphatic unsaturated dicarboxylic acid such as fumaric acid, maleic acid, or mesaconic acid, an aromatic dicarboxylic acid such as isophthalic acid or terephthalic acid, succinic acid, or trimellitic acid from the viewpoint of easily obtaining the effect of the invention.

In addition, examples of the polyhydric alcohol component may include a dihydric alcohol such as ethylene glycol, propylene glycol, butanediol, diethylene glycol, hexanediol, cyclohexanediol, octanediol, decanediol, dodecanediol, ethylene oxide adduct of bisphenol A, or propylene oxide adduct of bisphenol A; and a trihydric or higher polyol such as glycerin, pentaerythritol, hexamethylolmelamine, hexaethylolmelamine, tetramethylolbenzoguanamine, or tetraethylolbenzoguanamine. These polyhydric alcohol components may be used singly or as a mixture of two or more kinds thereof.

Among these, a divalent alcohol such as ethylene oxide adduct of bisphenol A or propylene oxide adduct of bisphenol A is preferable from the viewpoint of easily obtaining the effect of the invention.

The ratio of the polyhydric alcohol component to the polycarboxylic acid component used is set to preferably from 1.5/1 to 1/1.5 and more preferably from 1.2/1 to 1/1.2 in the equivalence ratio [OH]/[COOH] of the hydroxyl group [OH] in the polyhydric alcohol component to the carboxyl group [COOH] in the polycarboxylic acid component. It is easier to control the acid value and molecular weight of the crystalline polyester as the ratio of the polyhydric alcohol component to the polycarboxylic acid component used is in the above range.

The method for forming the amorphous polyester resin unit is not particularly limited, and it is possible to form the unit through the polycondensation (esterification) of the polycarboxylic acid component with the polyhydric alcohol component utilizing a known esterification catalyst.

The catalyst which can be used in the production of the amorphous polyester resin unit is the same one as the catalyst which is described in the section of <<crystalline polyester resin unit>> in the section of the (hybrid amorphous polyester resin (hybrid amorphous resin)) above, and thus the description thereof is omitted here.

The polymerization temperature is not particularly limited, but it is preferably from 150 to 250° C. In addition, the polymerization time is not particularly limited, but it is preferably from 0.5 to 10 hours. It is also possible to reduce the internal pressure of the reaction system during the polymerization if necessary.

The content of the amorphous polyester resin unit in the hybrid amorphous resin is preferably from 50 to 99.9% by mass, more preferably from 70 to 95% by mass, and even more preferably 80 to 95% by mass with respect to the total amount of the hybrid amorphous resin. As the content is set to be in the above range, it is possible to sufficiently decrease the crystallinity to the hybrid amorphous resin and also the toner to be finally obtained becomes one in which the charging uniformity, heat-resistant storage property, and HH transferability are all improved while favorable low temperature fixability is maintained. Incidentally, the constitutional component and proportion of each unit in the hybrid amorphous resin can be identified, for example, through the NMR measurement and the P-GC/MS measurement using a methylation reaction.

The hybrid amorphous resin contains the amorphous resin unit other than a polyester resin to be described in detail below in addition to the crystalline polyester resin unit. The hybrid amorphous resin may be in any form of a block copolymer, a graft copolymer, or the like as long as it contains the amorphous polyester resin unit and the amorphous resin unit other than a polyester resin which are described above, but it is preferably a graft copolymer. As the hybrid amorphous resin is a graft copolymer, the toner to be finally obtained becomes one in which the charging uniformity, heat-resistant storage property, and HH transferability are all improved while favorable low temperature fixability is maintained.

Furthermore, it is preferable that the hybrid amorphous resin has a structure in which the amorphous polyester resin unit is grafted to the amorphous resin unit other than a polyester resin of the main chain from the above viewpoint. In other words, the hybrid amorphous polyester resin is preferably a graft copolymer which has the amorphous resin unit other than a polyester resin as the main chain and the amorphous polyester resin unit as the side chain. By having such a form, the toner to be finally obtained becomes one in which the charging uniformity, heat-resistant storage property, and HH transferability are all improved while favorable low temperature fixability is maintained.

Incidentally, a substituent such as a sulfonic acid group, a carboxyl group, and a urethane group may be further introduced into the hybrid amorphous resin. The substituent may be introduced into the amorphous polyester resin unit or the amorphous resin unit other than a polyester resin to be described in detail below.

<<Amorphous Resin Unit Other than Polyester Resin>>

The amorphous resin unit other than a polyester resin (in the present specification, also simply referred to as the "amorphous resin unit" in some cases) is an essential unit for controlling the affinity of the amorphous resin constituting the core portion of the binder resin for the hybrid amorphous resin. As the amorphous resin unit is present, the affinity of the amorphous resin contained in the core portion for the hybrid amorphous resin contained in the shell portion is improved and it is possible to improve the charging uniformity and the like.

The amorphous resin unit is a moiety that is derived from an amorphous resin other than the amorphous polyester resin. It is possible to confirm the fact that the amorphous resin unit is contained in the hybrid amorphous resin (further, in the toner), for example, by identifying the chemical structure through the NMR measurement and the P-GC/MS measurement using a methylation reaction.

In addition, the amorphous resin unit is a resin unit which does not have a melting point but has a relatively high glass transition temperature (Tg) when a resin having the same chemical structure and molecular weight as those of the unit is subjected to the differential scanning calorimetry (DSC). At this time, the glass transition temperature (Tg) of the resin having the same chemical structure and molecular weight as those of the unit is preferably from 30 to 70° C. and even more preferably from 35 to 65° C.

The amorphous resin unit is not particularly limited as long as it is as defined above. For example, a resin having a structure in which another component is copolymerized to the main chain composed of an amorphous resin unit or a resin having a structure in which an amorphous resin unit is copolymerized to the main chain composed of another component corresponds to a hybrid amorphous resin having an amorphous resin unit of the invention when a toner containing this resin is one which has the amorphous resin unit as described above.

It is preferable that the amorphous resin unit is constituted by the same kind of resin as the amorphous resin contained in the core portion of the binder resin (namely, a resin contained in the core portion other than the hybrid crystalline resin). By having such a form, the affinity of the hybrid amorphous resin for the amorphous resin is further improved and a more uniform shell portion is easily formed.

The definition of the "same kind of resin" is described in the section of <<amorphous resin unit other than polyester resin>> above, and thus the detailed description thereof is omitted.

The examples, preferred form, forming method, and the like of the resin component constituting the amorphous resin unit are the same as those described in the section of <<amorphous resin unit other than polyester resin>> in (hybrid crystalline polyester resin (hybrid crystalline resin)) above, and thus the description thereof is omitted here.

The content of the amorphous resin unit in the hybrid amorphous resin is preferably from 0.1 to 50% by mass, more preferably from 3 to 30% by mass, and even more preferably 5 to 20% by mass with respect to the total amount of the hybrid amorphous resin. By setting the content to be in the above range, the affinity of the hybrid amorphous resin for the amorphous resin contained in the core potion increases and the toner to be finally obtained becomes one in which the charging uniformity, heat-resistant storage property, and HH transferability are all improved while favorable low temperature fixability is maintained.

<<Method for Producing Hybrid Amorphous Polyester Resin (Hybrid Amorphous Resin)>>

The method for producing the hybrid amorphous polyester resin contained in the binder resin according to the invention is not particularly limited as long as it is a method capable of forming a polymer having a structure in which the amorphous polyester resin unit and the amorphous resin unit are bonded to each other through molecular bonds. Examples of the specific method for producing the hybrid amorphous resin may include the methods to be described below.

(1) A method for producing the hybrid amorphous resin in which the amorphous resin unit is polymerized in advance and the amorphous polyester resin unit is formed by conducting a polymerization reaction in the presence of the amorphous resin unit (2) A method for producing the hybrid amorphous resin in which the amorphous polyester resin unit and the amorphous resin unit are formed, respectively and these are bonded to each other (3) A method for producing the hybrid amorphous resin in which the amorphous polyester resin unit is formed in advance and the amorphous resin unit is formed by conducting a polymerization reaction in the presence of the amorphous polyester resin unit It is possible to form the hybrid amorphous resin having a structure (graft structure) in which the amorphous polyester resin unit is bonded to the amorphous resin unit through molecular bonds by using the above methods.

Among the forming methods of (1) to (3) above, the method of (1) is preferable since it is easy to form the hybrid amorphous resin having a structure in which the amorphous polyester resin chain is grafted to the amorphous resin chain or it is possible to simplify the production process.

The details of the respective methods are the same as those described in the <<method for producing hybrid crystalline polyester resin (hybrid crystalline resin)>> above, and thus the description thereof is omitted here.

The shell portion may contain another resin such as an amorphous resin that is not hybridized in addition to the hybrid amorphous resin.

In addition, the weight average molecular weight (Mw) of the hybrid amorphous resin is preferably from 10,000 to 100,000 and more preferably from 20,000 to 90,000 from the viewpoint of achieving both the low temperature fixability and the heat-resistant storage property.

(SP Value of Core Portion and SP Value of Shell Portion)

It is preferable that the solubility parameter (SP value) (unit: $(cal/cm^3)^{1/2}$) of the core portion and the solubility parameter (SP value) (unit: $(cal/cm^3)^{1/2}$) of the shell portion satisfy the relation of the following Mathematical Formula (A).

[Mathematical Formula 1]

$$0.1\ (cal/cm^3)^{1/2} \leq |(\text{Solubility parameter of shell portion}) - (\text{Solubility parameter of core portion})| \leq 1.0\ (cal/cm^3)^{1/2} \quad (A)$$

By having such a difference in solubility parameter, the compatibility between the core portion and the shell portion is suppressed and the heat-resistant storage property is further improved.

The SP value (solubility parameter) is a factor to determine the solubility of the resin in a solvent. There is generally a tendency that a resin exhibiting polarity is highly soluble in a polar solvent but is poorly soluble in a non-polar solvent. On the other hand, a non-polar resin exhibits a reverse tendency. The factor to determine the strength of this affinity is the solubility parameter (SP value) represented by δ. In general, the solubility is higher as the difference in SP value between the solvent and the solute is smaller. In the present specification, the actual value of the SP value follows the values described in R. F. Fedors: Polym. Eng. Sci., 14 (2), 147-154 (1974), and the calculation of the SP value is conducted with reference to P 54-57 of the "Basic Science of Coating" (written by HARASAKI Yuji, MAKI bookstore).

Such a difference in solubility parameter can be controlled by controlling the kind of the resin in the core portion and the shell portion, the polar monomer amount and the polar group amount in the core portion and the shell portion, and the like.

(Content of Hybrid Crystalline Resin, Amorphous Resin, and Hybrid Amorphous Resin in Binder Resin)

The content of the hybrid crystalline resin in the binder resin is preferably from 3 to 50% by mass, more preferably from 4 to 40% by mass, and even more preferably from 5 to 30% by mass with respect to the entire binder resin. A toner in which the charging uniformity, heat-resistant storage property, and HH transferability are all improved while favorable low temperature fixability is maintained is obtained when the content is in this range.

In addition, the content of the amorphous resin in the binder resin is preferably from 50 to 97% by mass and more preferably from 70 to 95% by mass with respect to the entire binder resin. A toner in which the charging uniformity, heat-resistant storage property, and HH transferability are all improved while favorable low temperature fixability is maintained is obtained when the content is in this range.

Furthermore, the content of the hybrid amorphous resin in the binder resin is preferably from 3 to 50% by mass, more preferably from 4 to 40% by mass, and even more preferably from 5 to 30% by mass with respect to the entire binder resin. A toner in which the charging uniformity, heat-resistant storage property, and HH transferability are all improved while favorable low temperature fixability is maintained is obtained when the content is in this range.

<Other Components>

In the toner of the invention, internal additives such as a releasing agent, a colorant, and a charge control agent; and external additives such as inorganic fine particles, organic fine particles, and a lubricating material may be contained if necessary in addition to the essential components described above.

<Releasing Agent (Wax)>

The releasing agent constituting the toner is not particularly limited, and known ones can be used. Specific examples thereof may include polyolefin wax such as polyethylene wax and polypropylene wax, branched hydrocarbon wax such as microcrystalline wax, long chain hydrocarbon wax such as paraffin wax and Sasol wax, dialkyl ketone wax such as distearyl ketone, ester-based wax such as carnauba wax, montan wax, behenylbehenate, trimethylolpropanetribehenate, pentaerythritol tetrabehenate, pentaerythritol diacetate dibehenate, glycerin tribehenate, 1,18-octadecanediol distearate, tristearyl trimellitate, and distearyl maleate, amide-based wax such as ethylenediamine behenylamide and trimellitic acid tristearylamide.

The melting point of the releasing agent is preferably from 40 to 160° C. and more preferably from 50 to 120° C. By setting the melting point to be within the above range, it is possible to stably form the toner image without causing cold offset and the like even in the case of fixing at a low temperature in addition to that the heat-resistant storage property of the toner is secured. In addition, the content of the releasing agent in the toner is from 1 to 30% by mass and more preferably from 5 to 20% by mass.

<Colorant>

As the colorant that can constitute the toner, it is possible to arbitrarily use carbon black, a magnetic material, a dye, a pigment, and the like, and channel black, furnace black, acetylene black, thermal black, lamp black and the like are used as carbon black. It is possible to use ferromagnetic metals such as iron, nickel, and cobalt, any alloy containing these metals, compounds of ferromagnetic metals such as ferrite and magnetite, an alloy which does not contain a ferromagnetic metal but exhibits ferromagnetism through a heat treatment, for example, a kind of alloy called Heusler alloy such as manganese-copper-aluminum or manganese-copper-tin, chromium dioxide, and the like as the magnetic material.

As a black colorant, for example, carbon black such as furnace black, channel black, acetylene black, thermal black, and lamp black, and further magnetic powders such as magnetite and ferrite are used.

Examples of the colorant for magenta or red may include the C. I. Pigment Red 2, 3, 5, 6, 7, 15, 16, 48:1, 53:1, 57:1, 60, 63, 64, 68, 81, 83, 87, 88, 89, 90, 112, 114, 122, 123, 139, 144, 149, 150, 163, 166, 170, 177, 178, 184, 202, 206, 207, 209, 222, 238, and 269.

In addition, examples of the colorant for orange or yellow may include the C. I. Pigment Orange 31 and 43 and the C. I. Pigment Yellow 12, 14, 15, 17, 74, 83, 93, 94, 138, 155, 162, 180, and 185.

Furthermore, examples of the colorant for green or cyan may include the C. I. Pigment Blue 2, 3, 15, 15:2, 15:3, 15:4, 16, 17, 60, 62, and 66 and the C. I. Pigment Green 7.

These colorants may be used singly or in combination of two or more kinds thereof.

The amount of the colorant added is in a range of preferably from 1 to 30% by mass and more preferably from 2 to 20% by mass with respect to the entire toner, and it is also possible to use a mixture of these colorants. It is possible to secure the color reproducibility of an image when the amount is in such a range.

In addition, the size of the colorant is preferably from 10 to 1000 nm, more preferably from 50 to 500 nm, and even more preferably from 80 to 300 nm as the median diameter on a volume basis.

<Charge Control Agent>

As the charge control agent, it is possible to use a various known compounds such as nigrosine-based dye, a metal salt of naphthenic acid or higher fatty acid, an alkoxylated amine, a quaternary ammonium salt compound, an azo-based metal complex, and a salicylic acid metal salt.

The amount of the charge control agent added is usually an amount to be from 0.1 to 10% by mass and preferably from 0.5 to 5% by mass with respect to 100% by mass of the binder resin in the toner particles to be finally obtained.

The size of the charge control agent particles is from 10 to 1000 nm, preferably from 50 to 500 nm, and even more preferably from 80 to 300 nm as the number average primary particle size.

<External Additive>

It is possible to add known particles such as inorganic fine particles or organic fine particles and a lubricating material on the surface of the toner particles as the external additive from the viewpoint of improving the charging performance or flowability of the toner or the cleaning property.

Preferred examples of the inorganic fine particles may include inorganic fine particles composed of silica, titania (titanium oxide), alumina, and strontium titanate.

These inorganic fine particles may be subjected to the hydrophobing treatment if necessary.

It is possible to use spherical organic fine particles having a number average primary particle size of about from 10 to 2000 nm as the organic fine particles. Specifically, it is possible to use the organic fine particles composed of a homopolymer of styrene, methyl methacrylate, or the like or a copolymer thereof.

The lubricating material is one that is used for the purpose of further improving the cleaning property or transferability, and examples of the lubricating material may include metal salts of higher fatty acids such as zinc, aluminum, copper, magnesium, and calcium salts of stearic acid, zinc, manganese, iron, copper, and magnesium salts of oleic acid, zinc, copper, magnesium, and calcium salts of palmitic acid, zinc and calcium salts of linoleic acid, and zinc and calcium salts of ricinoleic acid. These external additives may be used in combination of various kinds thereof.

The amount of the external additive added is preferably from 0.1 to 10.0% by mass with respect to 100% by mass of the toner particles.

Examples of the method for adding the external additive may include a method in which the external additive is added using various known mixing devices such as the Turbula mixer, the Henschel mixer, the Nauta mixer, and a V-type mixer.

[Toner for Developing Electrostatic Charge Image (Toner)]

The average particle size of the toner of the invention is from 3.0 to 8.0 μm and preferably from 4.0 to 7.5 μm as the median diameter on a volume basis. As the average particle size is in the above range, the toner particles which have a great adhesive force so as to soar and adhere to the heating member to cause the fixing offset at the time of fixation decrease, the transfer efficiency increases so as to improve the halftone image quality, and the image quality such as fine lines or dots is improved. In addition, the toner flowability can also be secured.

The average particle size of the toner can be controlled by the concentration of the aggregating agent, the amount of the solvent, or the fusion time and further the composition of the binder resin in the aggregation and fusion step at the time of producing the toner.

In the toner for developing an electrostatic charge image of the invention, the average circularity represented by the following Mathematical Formula 1 is preferably from 0.920 to 1.000 and more preferably from 0.940 to 0.995 from the viewpoint of improving transfer efficiency.

[Mathematical Formula 2]

Average circularity=Circumference of circle determined from equivalent circle diameter/Circumference of particle projected image  Mathematical Formula 1

Incidentally, the average circularity can be measured, for example, using the average circularity measuring device "FPIA-2100" (manufactured by Sysmex Corporation).

<Method for Producing Toner of the Invention>

The method for producing the toner of the invention is not particularly limited, and examples thereof may include known method such as a kneading pulverization method, a suspension polymerization method, an emulsion aggregation method, a dissolution suspension method, a polyester extension method, and dispersion polymerization method.

Among these, it is preferable to employ the emulsion aggregation method from the viewpoint of uniformity of particle size, controllability of the shape, and ease of formation of the core-shell structure. The emulsion aggregation method will be described below.

(Emulsion Aggregation Method)

The emulsion aggregation method is a method for forming toner particles in which a dispersion of the fine particles of a resin (hereinafter, also referred to as the "resin fine particles") dispersed using a surfactant or a dispersion stabilizer is mixed with a dispersion of the toner particle constituting component such as fine particles of a colorant, the particles are aggregated until the desired toner particle size is obtained by adding an aggregating agent, and the fusion among the resin fine particles is conducted after or at the same time with the aggregation to control the shape.

Here, the resin fine particles can also be composite particles formed of a multilayer of two or more layers which are composed of resins having different compositions.

The resin fine particles can be produced by, for example, an emulsion polymerization method, a mini-emulsion polymerization method, or a phase-transfer emulsification method or by combining several methods. In the case of containing the internal additive to the resin fine particles, it is preferable to use the mini-emulsion polymerization method among them.

In the case of containing the internal additive to the toner particles, the resin fine particles containing the internal additive may be prepared, or a dispersion of the internal additive fine particles composed of only the internal additive may be prepared separately, and the internal additive fine particles may be aggregated together when aggregating the resin fine particles.

In addition, it is also possible to obtain toner particles having a core-shell structure by the emulsion aggregation method, specifically the toner particles having a core-shell structure can be obtained as follows. First, the binder resin fine particles for core particles and the colorant are aggregated (and fused) to prepare the core particles, next, the binder resin fine particles for shell portion are added to the dispersion of the core particles, and the binder resin fine particles for shell portion are aggregated and fused on the core particle surface to form the shell portion which coats the core particle surface.

In the case of producing the toner by the emulsion aggregation method, the method for producing the toner according to a preferred embodiment includes a step (a) (hereinafter, also referred to as the preparation step) of preparing a hybrid crystalline polyester resin fine particle dispersion, an amorphous resin fine particle dispersion, and a hybrid amorphous polyester resin fine particle dispersion and a step (b) (hereinafter, also referred to as the aggregation and fusion step) of mixing, aggregating, and fusing the hybrid crystalline polyester resin fine particle dispersion, the amorphous resin fine particle dispersion, and the hybrid amorphous polyester resin fine particle dispersion.

Hereinafter, each of the steps (a) and (b) and each of the steps (c) to (e) which are arbitrarily carried out other than these steps will be described in detail.

(A) Preparation Step

The step (a) includes the following hybrid crystalline resin fine particle dispersion preparation step, an amorphous resin fine particle dispersion preparation step, and a hybrid amorphous resin fine particle dispersion preparation step, and it also includes a colorant dispersion preparation step and a releasing agent fine particle dispersion preparation step if necessary.

(a-1) Hybrid Crystalline Resin Fine Particle Dispersion Preparation Step

The hybrid crystalline resin fine particle dispersion preparation step is a step of preparing a dispersion of hybrid crystalline resin fine particles by synthesizing a hybrid crystalline resin constituting the toner particles and dispersing this hybrid crystalline resin in an aqueous medium in the form of fine particles.

The method for producing the hybrid crystalline resin is as described above, and thus the details are omitted, but it is preferable to set the proportion of the crystalline polyester resin unit and the amorphous resin unit contained in the hybrid crystalline resin to be in the preferred range described above.

Examples of the method for preparing the hybrid crystalline resin fine particle dispersion may include a method in which the hybrid crystalline resin is subjected to the dispersion treatment in an aqueous medium without using a solvent or a method in which the hybrid crystalline resin is dissolved in a solvent such as ethyl acetate to prepare a solution and the solution is emulsified and dispersed in an aqueous medium using a dispersing machine and then subjected to the solvent removal treatment.

In the invention, the "aqueous medium" refers to those which contain water at least at 50% by mass or more, and an organic solvent soluble in water can be mentioned as a component other than water and examples thereof may include methanol, ethanol, isopropanol, butanol, acetone, methyl ethyl ketone, dimethylformamide, methyl cellosolve, and tetrahydrofuran. Among these, it is preferable to use an alcohol-based organic solvent, such as methanol, ethanol, isopropanol, or butanol, of an organic solvent which does not dissolve the resin. Preferably, only water is used as the aqueous medium.

The hybrid crystalline resin contains a carboxyl group in the crystalline polyester resin unit in some cases. In such a case, ammonia, sodium hydroxide, and the like may be added in order to smoothly conduct the emulsification by dissociating the carboxyl group contained in the unit as an ion and stably emulsifying the hybrid crystalline resin in the aqueous phase.

Furthermore, a dispersion stabilizer may be dissolved in the aqueous medium or a surfactant or resin fine particles may be added to the aqueous medium for the purpose of improving the dispersion stability of oil droplets.

As the dispersion stabilizer, it is possible to use known ones, and for example, it is preferable to use those that are soluble in an acid or an alkali, such as tricalcium phosphate, or it is preferable to use those that can be degraded by an enzyme from the environmental viewpoint.

As the surfactant, it is possible to use an anionic surfactant, a cationic surfactant, a nonionic surfactant, and an amphoteric surfactant which are known.

In addition, examples of the resin fine particles for improving the dispersion stability may include polymethyl methacrylate resin fine particles, polystyrene resin fine particles, and polystyrene-acrylonitrile resin fine particles.

Such a dispersion treatment can be conducted by utilizing the mechanical energy, and the dispersing machine is not particularly limited and examples thereof may include a homogenizer, a low speed shearing type dispersing machine, a high speed shearing type dispersing machine, a friction type dispersing machine, a high pressure jet type dispersing machine, an ultrasonic dispersing machine, a high pressure impact type dispersing machine Ultimizer, and an emulsifying dispersing machine.

It is preferable to heat the solution during the dispersion. The heating condition is not particularly limited, but it is usually about from 60 to 100° C.

The particle size of the hybrid crystalline resin fine particles (oil droplets) in the hybrid crystalline resin fine particle dispersion thus prepared is preferably from 60 to 1000 nm and more preferably from 80 to 500 nm as a median diameter on a volume basis. Incidentally, this median diameter on a volume basis is measured by the method described in Examples. Incidentally, this median diameter on a volume basis of the oil droplets can be controlled by the intensity of the mechanical energy at the time of the emulsifying and dispersing.

In addition, the content of the hybrid crystalline resin fine particles in the hybrid crystalline resin fine particle dispersion is preferably in a range of from 10 to 50% by mass and more preferably from 15 to 40% by mass with respect to 100% by mass of the dispersion. It is possible to suppress broadening of the particle size distribution and to improve the toner properties when the content is in such a range.

(a-2) Amorphous Resin Fine Particle Dispersion Preparation Step

The amorphous resin fine particle dispersion preparation step is a step of preparing a dispersion of amorphous resin fine particles by synthesizing an amorphous resin constituting the toner particles and dispersing this amorphous resin in an aqueous medium in the form of fine particles.

The method for producing the amorphous resin is as described above, and thus the details thereof are omitted.

Examples of the method for dispersing the amorphous resin in an aqueous medium may include (I) a method in which the amorphous resin fine particles are formed from a monomer for obtaining an amorphous resin and an aqueous dispersion of the amorphous resin fine particles is prepared, and (II) a method in which the amorphous resin is dissolved or dispersed in an organic solvent (solvent) to prepare an oil phase liquid, the oil phase liquid is dispersed in an aqueous medium by phase-transfer emulsification or the like to form oil droplets in a controlled state so as to have a desired particle size, and the organic solvent (solvent) is then removed.

In the method (I), it is preferable to use a method in which first, the monomer for obtaining an amorphous resin is added to the aqueous medium together with a polymerization initiator and polymerized to obtain basic particles, next, a radical polymerizable monomer for obtaining an amorphous resin and a polymerization initiator are added to the dispersion in which the resin fine particles are dispersed, and the radically polymerizable monomer is seed polymerized to the basic particles.

At this time, it is possible to use a water-soluble polymerization initiator as the polymerization initiator. It is possible to suitably use, for example, a water-soluble radical polymerization initiator such as potassiumpersulfate or ammonium persulfate as the water-soluble polymerization initiator.

In addition, it is possible to use a chain transfer agent that is generally used in the seed polymerization reaction system for obtaining the amorphous resin fine particles for the purpose of adjusting the molecular weight of the amorphous resin. It is possible to use a mercaptan such as octyl mercaptan, dodecyl mercaptan, or t-dodecylmercaptan; a mercaptopropionic acid ester such as n-octyl-3-mercaptopropionate or stearyl-3-mercaptopropionate; styrene dimer; and the like as the chain transfer agent. These may be used singly or in combination of two or more kinds thereof.

Incidentally, in the method (I), a releasing agent may be contained in the core portion by dispersing the releasing agent together with the monomer when forming the amorphous resin fine particles from the monomer for obtaining an amorphous resin.

In the method (II), as the organic solvent (solvent) used in the preparation of the oil phase liquid, those which have a low boiling point and exhibit low solubility in water are preferable from the viewpoint of ease of removal treatment after the formation of oil droplets in the same manner as above, and specific examples thereof may include methyl acetate, ethyl acetate, methyl ethyl ketone, isopropyl alcohol, methyl isobutyl ketone, toluene, and xylene. These may be used singly or in combination of two or more kinds thereof.

The amount of the organic solvent (solvent) used (total amount thereof in the case of using two or more kinds) is generally from 10 to 500 parts by mass, preferably from 100 to 450 parts by mass, and more preferably from 200 to 400 parts by mass with respect to 100 parts by mass of the amorphous resin.

The amount of the aqueous medium used is preferably from 50 to 2,000 parts by mass and more preferably from 100 to 1,000 parts by mass with respect to 100 parts by mass of the oil phase liquid. It is possible to emulsify and disperse the oil phase liquid in an aqueous medium to a desired particle size by setting the amount of the aqueous medium used to be in the above range.

In addition, in the same manner as above, a dispersion stabilizer may be dissolved in the aqueous medium, and a surfactant or resin fine particles may be added to the aqueous medium for the purpose of improving the dispersion stability of the oil droplets.

Such emulsification and dispersion of the oil phase liquid can be conducted utilizing the mechanical energy in the same manner as above, and the dispersing machine for conducting the emulsification and dispersion is not particularly limited and those described in (a-1) above can be used.

The removal of the organic solvent after the formation of oil droplets can be conducted by an operation in which the entire dispersion in a state that the amorphous resin fine particles are dispersed in an aqueous medium is gradually heated to raise the temperature while stirring and then vigorously stirred in a constant temperature region, and the solvent is then removed. Alternatively, it is possible to remove the solvent while reducing the pressure using an apparatus such as an evaporator.

The particle size of the amorphous resin fine particles (oil droplets) in the amorphous resin fine particle dispersion prepared by the method (I) or (II) is preferably from 60 to 1000 nm and even more preferably from 80 to 500 nm as a median diameter on a volume basis. Incidentally, this median diameter on a volume basis is measured by the method described in Examples. Incidentally, the median diameter on a volume basis of the oil droplets can be controlled by the intensity of the mechanical energy at the time of emulsifying and dispersing.

In addition, the content of the amorphous resin fine particles in the amorphous resin fine particle dispersion is preferably in a range of from 5 to 50% by mass and more preferably in a range of from 10 to 30% by mass. It is possible to suppress broadening of the particle size distribution and to improve the toner properties when the content is in such a range.

(a-3) Hybrid Amorphous Resin Fine Particle Dispersion Preparation Step

The hybrid amorphous resin fine particle dispersion preparation step is a step of preparing a dispersion of hybrid amorphous resin fine particles by synthesizing a hybrid amorphous resin constituting the toner particles and dispersing this hybrid amorphous resin in an aqueous medium in the form of fine particles.

The specific method thereof is the same as that described in (a-1) the hybrid crystalline resin fine particle dispersion preparation step, and thus the description thereof is omitted here.

(a-4) Colorant Dispersion Preparation Step/Releasing Agent Fine Particle Dispersion Preparation Step The colorant dispersion preparation step is a step of preparing a dispersion of colorant fine particles by dispersing the colorant in an aqueous medium in the form of fine particles. In addition, the releasing agent fine particle dispersion preparation step is a step that is carried out if necessary in the case of desiring releasing agent-containing toner particles and is a step of preparing a dispersion of releasing agent fine particles by dispersing the releasing agent in an aqueous medium in the form of fine particles.

The aqueous medium is as described in (a-1) above, and a surfactant or resin fine particles may be added to the aqueous medium for the purpose of improving the dispersion stability.

The dispersion of the colorant/release agent can be can be conducted utilizing the mechanical energy, and such a dispersing machine is not particularly limited and those described in (a-1) above can be used.

The content of the colorant in the colorant dispersion is preferably in a range of from 10 to 50% by mass and more preferably in a range of from 15 to 40% by mass. An effect of securing the color reproducibility is exhibited when the content is in such a range. The content of the releasing agent fine particles in the releasing agent fine particle dispersion is preferably in a range of from 10 to 50% by mass and more preferably in a range of from 15 to 40% by mass. An effect of preventing the hot offset and securing the separability is obtained when the content is in such a range.

(b) Aggregation and Fusion Step

The aggregation and fusion step is a step of obtaining a binder resin by aggregating the hybrid crystalline resin fine particles, the amorphous resin fine particles, and the hybrid amorphous resin fine particles which are described above and the colorant particles and/or the releasing agent fine particles if necessary in an aqueous medium and fusing these particles at the same time with aggregation.

In this step, first, the hybrid crystalline resin fine particles and the amorphous resin fine particles and the colorant particles and/or the releasing agent fine particles if necessary are mixed together, and these particles are dispersed in an aqueous medium. Next, an alkali metal salt or a salt containing a group 2 element is added thereto as an aggregating agent, the resultant dispersion is then heated at a temperature equal to or higher than the glass transition temperature of the hybrid crystalline resin fine particles and the amorphous resin fine particles to conduct the aggregation and the resin particles are fused to one another at the same time.

Specifically, the core portion of the binder resin is formed by mixing the dispersion of the hybrid crystalline resin, the dispersion of the amorphous resin, and the colorant particle dispersion and/or the releasing agent fine particle dispersion if necessary which are prepared in the previous procedure and adding an aggregating agent such as magnesium chloride to aggregate the hybrid crystalline resin fine particles and the amorphous resin fine particles and colorant particles and/or the releasing agent fine particles if necessary and to fuse the particles with one another at the same time.

The aggregating agent used in the present step is not particularly limited, but those selected from the metal salts are preferably used. There are, for example, a slat of a monovalent metal such as a salt of an alkali metal such as sodium, potassium, or lithium, for example, a salt of a divalent metal such as calcium, magnesium, manganese, or copper, a salt of a trivalent metal such as iron or aluminum, and the like. Specific examples of the salt may include sodium chloride, potassium chloride, lithium chloride, calcium chloride, magnesium chloride, zinc chloride, copper sulfate, magnesium sulfate, and manganese sulfate, and a salt of a divalent metal is even more preferable among these. It is possible to conduct the aggregation with a smaller amount when a salt of a divalent metal is used. These aggregating agents may be used singly or in combination of two or more kinds thereof.

In the aggregation step, it is preferable to minimize the standing time (time until heating is started) to leave to stand after the aggregating agent is added. In other words, it is preferable to start heating of the dispersion for aggregation as soon as possible after the aggregating agent is added and to raise the temperature equal to or higher than the glass transition temperature of the hybrid crystalline resin and the amorphous resin. The reason for this is not clear, but this is because it is concerned that the aggregation state of the particles varies depending on the passage of the standing time and thus a problem is caused that the particle size distribution of the toner particles obtained is unstable or the surface properties vary. The standing time is usually set to be within 30 minutes and preferably within 10 minutes. The temperature for adding the aggregating agent is not particularly limited, but it is preferably equal to or lower than the glass transition temperature of the hybrid crystalline resin and the amorphous resin of the core portion.

In addition, in the aggregation step, it is preferable to rapidly raise the temperature by heating after the aggregating agent is added, and the temperature raising rate is preferably set to 0.8° C./min or more. The upper limit of the temperature raising rate is not particularly limited, but it is preferably set to 15° C./min or less from the viewpoint of suppressing the generation of coarse particles by rapid progress of fusing. Furthermore, it is important to continue fusion (first aging step) by keeping the temperature of the dispersion for aggregation after the dispersion for aggregation has reached the glass transition temperature or higher for a predetermined time and preferably until the median diameter on a volume basis reaches from 4.5 to 7.0 μm. In order to obtain the binder resin having a core-shell structure of the invention, an aqueous dispersion of the hybrid amorphous resin fine particles for forming the shell portion is further added after the first aging step, and the hybrid amorphous resin for forming the shell portion is aggregated and fused on the surface of the particles (core particles) of the binder resin obtained above. By virtue of this, a binder resin having a core-shell structure is obtained (shell formation step). Thereafter, the aggregation is stopped by adding a salt such as saline when the size of the aggregated particles reaches the targeted size. Thereafter, the heat treatment of the reaction system may be further conducted (second aging step) until the aggregation and fusion of the shell portion to the core particle surface become robuster and the shape of the particles becomes a desired shape. This second aging step may be carried out until the average circularity of the toner particles having a core-shell structure reaches the range of the average circularity described above.

By virtue of this, it is possible to effectively conduct the growth of the particles (aggregation of the hybrid crystalline resin fine particles, the amorphous resin fine particles, and the hybrid amorphous resin, and the colorant particles/the releasing agent fine particles if necessary) and the fusion (loss of the interface between particles) and to improve the durability of the toner particles to be finally obtained.

(c) Cooling Step

The cooling step is a step of subjecting the dispersion of the toner particles to the cooling treatment. The cooling rate in the cooling treatment is not particularly limited, but it is preferably from 0.2 to 20° C./min. The method for cooling treatment is not particularly limited, and examples thereof may include a method in which the dispersion of the toner particles is cooled by introducing a coolant from the outside of the reaction vessel or a method in which the dispersion of the toner particles is cooled by directly introducing cold water into the reaction system.

(d) Filtration, Washing, and Drying Steps

In the filtration step, the toner maternal particles are filtered from the dispersion of the toner particles. There are a centrifugal separation method, a reduced pressure filtration method which is carried out using the Nutsche or the like, a filtration method which is carried out using a filter press or the like, and the like as the method for filtration treatment, and the method is not particularly limited.

Subsequently, the adhered substances such as the surfactant or the aggregating agent are removed from the filtered toner maternal particles (cake-like aggregate material) by being washed in the washing step. The washing step is one in which the washing treatment is conducted with water until the electric conductivity of the filtrate reaches, for example, a level of from 5 to 10 μS/cm.

In the drying step, the toner maternal particles subjected to the washing step are subjected to the drying treatment. Examples of the dryer used in the drying step may include a known dryer such as a spray dryer, a vacuum freeze dryer, or a vacuum dryer, and it is also possible to use a shelf-type static dryer, a shelf-type mobile drier, a fluidized bed drier, a rotary dryer, a stirring-type dryer, and the like. The water content contained in the dried toner maternal particles is preferably 5% by mass or less and more preferably 2% by mass or less.

In addition, the crushing treatment may be conducted in a case in which the toner maternal particles subjected to the drying treatment are aggregated with one another by a weak inter-particle attractive force. It is possible to use a mechanical crushing device such as a jet mill, the Henschel mixer, a coffee mill, or a food processor as the crushing device.

(e) External Additive Treatment Step

This step is a step of preparing a toner by adding the external additive to the surface of toner maternal particles subjected to the drying treatment and mixing them if necessary. By the addition of the external additive, the flowability or charging property of the toner is improved and the improvement in cleaning property, and the like are realized.

(Developer)

The toner as described above is considered to be used, for example, as one-component magnetic toner by containing a magnetic material, a two-component developer by mixing with a so-called carrier, and a non-magnetic toner singly, and it can be suitably used in any case.

As the carrier constituting the two-component developer, it is possible to use magnetic particles composed of materials known in the prior art such as a metal including iron, ferrite, or magnetite, and an alloy of those metals with a metal such as aluminum or lead, and in particular it is preferable to use ferrite particles.

As the carrier, those which have a median diameter on a volume basis of from 15 to 100 μm are preferable and those which have a median diameter on a volume basis of from 25 to 60 μm are more preferable.

As the carrier, it is preferable to use those which are further coated with a resin or a so-called dispersed in resin type carrier in which the magnetic particles are dispersed in a resin. The composition of the resin for coating is not particularly limited, but for example, an olefin resin, a cyclohexyl methacrylate-methyl methacrylate copolymer, a styrene resin, a styrene-acrylic resin, a silicone resin, an ester resin, or a fluorine resin is used. In addition, the resin for constituting the dispersed in resin type carrier is not particularly limited, and known ones can be used, and it is possible to use, for example, an acrylic resin, a styrene-acrylic resin, a polyester resin, a fluorine resin, and a phenol resin.

<Fixing Method>

Examples of a suitable fixing method using the toner of the invention may include a so-called contact heating method. Examples of the contact heating method may include particularly a heat and pressure fixing method and further a heat roll fixing method and a pressure and heat fixing method in which the toner is fixed by a pressure member which involves a heating body disposed to be fixed and rotates.

Embodiments of the invention have been described above, but the invention is not limited to the embodiments described above and can be variously modified.

EXAMPLES

Hereinafter, the invention will be further described with reference to the representative embodiments of the invention, but the invention is not limited to these embodiments as a matter of course. Incidentally, unless otherwise stated, in Examples, the term "parts" refers to "parts by mass" and the symbol "%" refers to "% by mass". Incidentally, the values described in "R. F. Fedors: Polym. Eng. Sci., 14 (2), 147-154 (1974)" are used as the solubility parameter (SP value) of the core portion and shell portion constituting the toner, and the calculation of the SP value was conducted with reference to pages 54 to 57 of the "Basic Science of Coating" (written by Yuji HARASAKI, MAKI bookstore).

(Measurement of Weight Average Molecular Weight (Mw))

The weight average molecular weight (Mw) (in terms of polystyrene) of each resin was measured using the HLC-8120GPC and the SC-8020 apparatus manufactured by Tosoh Corporation as the GPC apparatus, using the TSKgel, Super HM-H (6.0 mm ID×15 cm×2) as the column, and using THF (tetrahydrofuran) for chromatograph manufactured by Wako Pure Chemical Industries, Ltd. as the eluent. As the experimental conditions, the experiment was conducted at a sample concentration of 0.5%, a flow rate of 0.6 ml/min, a sample injection volume of 10 μl, and the measurement temperature of 40° C. using an IR detector. In addition, the calibration curve was created from 10 samples of the "polystyrene standard sample TSK standard": A-500, F-1, F-10, F-80, F-380, A-2500, F-4, F-40, F-128, and F-700 manufactured by Tosoh Corporation. In addition, the data collection interval in the sample analysis was 300 ms.

(Average Particle Size of Resin Particles, Colorant Particles, and the Like)

The median diameter on a volume basis of the resin particles, the colorant particles, and the like was measured using a laser diffraction type particle size distribution measuring apparatus (LA-700 manufactured by HORIBA, Ltd.).

<Production of Toner Particles>

Synthesis Example 1: Synthesis of Hybrid Crystalline Polyester Resin A

The following raw material monomer of an addition polymerization-based resin (styrene-acrylic resin: StAc) unit containing an amphoterically reactive monomer and the following radical polymerization initiator were put in a dropping funnel.

| | |
|---|---|
| Styrene | 42 parts by mass |
| n-butyl acrylate | 11 parts by mass |
| Acrylic acid | 5 parts by mass |
| Polymerization initiator (di-t-butyl peroxide) | 7 parts by mass |

In addition, the following raw material monomer of the polycondensation-based resin (crystalline polyester resin: CPEs) unit was put in a four-necked flask equipped with a nitrogen inlet tube, a dehydrating tube, a stirrer, and a thermocouple and dissolved by heating to 170° C.

| | |
|---|---|
| Dodecanedioic acid | 318 parts by mass |
| 1,6-hexanediol | 196 parts by mass |

Subsequently, the raw material monomer of the addition polymerization-based resin (StAc) was added thereto dropwise over 90 minutes under stirring, the resultant was aged for 60 minutes, and then the unreacted addition polymerization monomer was removed therefrom under reduced pressure (8 kPa). Incidentally, the amount of the monomer that was removed at this time was a significantly small amount as compared to the ratio of the raw material monomer of the resin.

Thereafter, 0.8 part by mass of $Ti(OBu)_4$ as an esterification catalyst was put therein, the temperature thereof was raised up to 235° C., and the reaction thereof was conducted for 5 hours at the atmospheric pressure (101.3 kPa) and further for 1 hour under reduced pressure (8 kPa).

Next, the resultant was cooled to 200° C. and then allowed to react for 1 hour under reduced pressure (20 kPa), thereby obtaining the hybrid crystalline polyester resin A. The hybrid crystalline polyester resin A was a resin which contained the resin (StAc) unit other than the CPEs at 10% by mass with respect to the entire amount of the resin and had a graft structure having StAc as the main chain and CPEs as the side chain. Furthermore, the weight average molecular weight (Mw) of the hybrid crystalline polyester resin A was 28,000.

Synthesis Examples 2 and 3: Synthesis of Hybrid Crystalline Polyester Resins B and C The hybrid crystalline polyester resins B and C were obtained in the same manner as in the Synthesis Example 1 above except that the amount of the raw material monomer of the polycondensation-based resin (CPEs) added was changed so that the proportion of the addition polymerization-based resin (StAc) unit contained in the hybrid crystalline polyester resin became the values presented in Table 1. Incidentally, at this time, the composition ratio of the raw material monomer and the added amount of the raw material monomer of the addition polymerization-based resin (StAc) and the composition ratio of the raw material monomer of the polycondensation-based resin (CPEs) were set to be the same as those in the Synthesis Example 1 above. The weight average molecular weights (Mw) of the hybrid crystalline polyester resins B and C are presented in Table 1, respectively.

Synthesis Examples 4 to 7: Synthesis of Hybrid Crystalline Polyester Resins D to G The hybrid crystalline polyester resins D to G were obtained in the same manner as in the Synthesis Example 1 above except that the kind and the added amount of the raw material monomer of the polycondensation-based resin (CPEs) unit were changed as follows, respectively. Incidentally, at this time, the composition ratio of the raw material monomer and the added amount of the raw material monomer of the addition polymerization-based resin (StAc) were set to be the same as those in the Synthesis Example 1 above. The weight average molecular weights (Mw) of the hybrid crystalline polyester resins D to G are presented in Table 1, respectively.

<<Hybrid Crystalline Polyester Resin D>>

| | |
|---|---|
| Tetradecanedioic acid | 357 parts by mass |
| 1,4-butanediol | 149 parts by mass |

<<Hybrid Crystalline Polyester Resin E>>

| | |
|---|---|
| Sebacic acid | 279 parts by mass |
| 1,9-nonanediol | 264 parts by mass |

<<Hybrid Crystalline Polyester Resin F>>

| | |
|---|---|
| Sebacic acid | 279 parts by mass |
| 1,10-decanediol | 288 parts by mass |

<<Hybrid Crystalline Polyester Resin G>>

| | |
|---|---|
| Sebacic acid | 279 parts by mass |
| 1,12-dodecanediol | 334 parts by mass |

Synthesis Examples 8 and 9: Synthesis of Hybrid Crystalline Polyester Resins H And I The hybrid crystalline polyester resins H and I were obtained in the same manner as in the Synthesis Example 1 above except that the added amount of the raw material monomer of the polycondensation-based resin (CPEs) was changed so that the proportion of the addition polymerization-based resin (StAc) unit contained in the hybrid crystalline polyester resin became the values presented in Table 1. Incidentally, at this time, the composition ratio of the raw material monomer and the added amount of the raw material monomer of the addition polymerization-based resin (StAc) and the composition ratio of the raw material monomer of the polycondensation-based resin (CPEs) were set to be the same as those in the Synthesis Example 1 above. The weight average molecular weights (Mw) of the hybrid crystalline polyester resins H and I are presented in Table 1, respectively.

Synthesis Example 10: Synthesis of Hybrid Crystalline Polyester Resin J

The following raw material monomer of an addition polymerization-based resin (styrene-acrylic resin: StAc) unit containing an amphoterically reactive monomer and the following radical polymerization initiator were put in a dropping funnel.

| | |
|---|---|
| Styrene | 42 parts by mass |
| n-butyl acrylate | 11 parts by mass |
| Acrylic acid | 5 parts by mass |
| Polymerization initiator (di-t-butyl peroxide) | 7 parts by mass |

Subsequently, the raw material monomer of the addition polymerization-based resin (StAc) unit was added dropwise over 90 minutes under stirring, the resultant was aged for 60 minutes, and the unreacted addition polymerization monomer was then removed therefrom under reduced pressure (8 kPa), thereby obtaining the vinyl resin (1) (styrene-acrylic resin: StAc). Incidentally, the amount of the monomer that was removed at this time was a significantly small amount as compared to the ratio of the raw material monomer of the resin.

Separately, 318 parts by mass of dodecanedioic acid and 196 parts by mass of 1,6-hexanediol were put in a reaction vessel equipped with a stirrer, a thermometer, a cooling tube, and a nitrogen gas inlet tube. The inside of the reaction vessel was purged with dry nitrogen gas, 0.1 part by mass of $Ti(OBu)_4$ was then added thereto, and the reaction thereof was conducted for 8 hours at about 180° C. in a nitrogen gas stream while stirring. Further, 0.2 part by mass of $Ti(OBu)_4$ was further added thereto, the temperature thereof was raised up to about 220° C., and the reaction thereof was conducted for 6 hours while stirring, the internal pressure of the reaction vessel was then reduced to 1.33 kPa (10 mmHg), and thus the reaction was conducted under reduced pressure, thereby obtaining the crystalline polyester resin (1). The weight average molecular weight (Mw) of the crystalline polyester resin (1) was 29,000.

The vinyl resin (1) obtained above was graft-polymerized to the crystalline polyester resin (1) by the following procedure, thereby synthesizing the hybrid crystalline polyester resin J having a graft structure in which the crystalline polyester resin (CPEs) was the main chain and the vinyl resin (StAc) was the side chain.

First, 90 parts by mass of the crystalline polyester resin (1) and 10 parts by mass of the vinyl resin (1) were dissolved in 100 parts by mass of toluene, and the solution was put in a flask equipped with a cooling tube and then heated for 5 hours at 120° C. in a nitrogen stream to conduct the polymerization reaction.

Next, the polymer was taken out by dissolving in THF and reprecipitated by being added dropwise to methanol, the precipitate was then filtered, further washed with methanol repeatedly, and then subjected to vacuum drying at 40° C., thereby obtaining the hybrid crystalline polyester resin J. The weight average molecular weight (Mw) of the hybrid crystalline polyester resin J was 31,000.

Synthesis Example 11: Synthesis of Hybrid Crystalline Polyester Resin K

The vinyl resin (1) and the crystalline polyester resin (1) which were obtained in the Synthesis Example 10 above were block-copolymerized by the following procedure.

First, 90 parts by mass of the crystalline polyester resin (1) and 10 parts by mass of the vinyl resin (1) were put in a glass vessel equipped with a reflux cooling tube, a nitrogen inlet tube, and a stirrer, and dissolved by stirring at 50° C., 2.7 parts by mass of dicyclohexylcarbodiimide (DCC) and 0.17 part by mass of dimethylaminopyridine (DMAP) were added thereto, and the reaction thereof was conducted for 2 hours at 50° C., thereby obtaining the hybrid crystalline polyester resin K, which is a block copolymer of a vinyl resin and a crystalline polyester resin. The weight average molecular weight (Mw) of the hybrid crystalline polyester resin K was 30,000.

The structures of the hybrid crystalline polyester resins synthesized in the Synthesis Examples 1 to 11 are presented in the following Table 1. Incidentally, the crystalline polyester resin (1) synthesized in the Synthesis Example 10 above was used as it was as the crystalline polyester resin L.

TABLE 1

| | Weight average molecular weight (Mw) | Crystalline polyester resin unit | | Unit other than crystalline polyester resin | | |
|---|---|---|---|---|---|---|
| | | Dicarboxylic acid | Diol | Kind | Ratio (% by mass) | Structure |
| Hybrid crystalline polyester resin A | 27,000 | Dodecanedioic acid | 1,6-hexanediol | StAc resin | 10 | Crystalline polyester resin is grafted to StAc resin |
| Hybrid crystalline polyester resin B | 30,000 | Dodecanedioic acid | 1,6-hexanediol | StAc resin | 5 | Crystalline polyester resin is grafted to StAc resin |
| Hybrid crystalline polyester resin C | 28,000 | Dodecanedioic acid | 1,6-hexanediol | StAc resin | 30 | Crystalline polyester resin is grafted to StAc resin |
| Hybrid crystalline polyester resin D | 29,000 | Tetradecanedioic acid | 1,4-butanediol | StAc resin | 10 | Crystalline polyester resin is grafted to StAc resin |
| Hybrid crystalline polyester resin E | 27,000 | Sebacic acid | 1,9-nonanediol | StAc resin | 10 | Crystalline polyester resin is grafted to StAc resin |
| Hybrid crystalline polyester resin F | 22,000 | Sebacic acid | 1,10-decanediol | StAc resin | 4 | Crystalline polyester resin is grafted to StAc resin |
| Hybrid crystalline polyester resin G | 16,000 | Sebacic acid | 1,12-dodecanediol | StAc resin | 31 | Crystalline polyester resin is grafted to StAc resin |
| Hybrid crystalline polyester resin H | 5,100 | Dodecanedioic acid | 1,6-hexanediol | StAc resin | 10 | Crystalline polyester resin is grafted to StAc resin |
| Hybrid crystalline polyester resin I | 58,000 | Dodecanedioic acid | 1,6-hexanediol | StAc resin | 10 | Crystalline polyester resin is grafted to StAc resin |
| Hybrid crystalline polyester resin J | 31,000 | Dodecanedioic acid | 1,6-hexanediol | StAc resin | 10 | StAc resin is grafted to crystalline polyester resin |

TABLE 1-continued

| | Weight average molecular weight (Mw) | Crystalline polyester resin unit | | Unit other than crystalline polyester resin | | |
|---|---|---|---|---|---|---|
| | | Dicarboxylic acid | Diol | Kind | Ratio (% by mass) | Structure |
| Hybrid crystalline polyester resin K | 30,000 | Dodecanedioic acid | 1,6-hexanediol | StAc resin | 10 | Straight-chain block copolymer of StAc resin and crystalline polyester resin |
| Crystalline polyester resin L | 29,000 | Dodecanedioic acid | 1,6-hexanediol | — | — | — |

Production Example 1: Preparation of Aqueous Dispersion (A) of Fine Particles of Hybrid Crystalline Polyester Resin A 30 parts by mass of the hybrid crystalline polyester resin A obtained in the Synthesis Example 1 above was melted and transferred to an emulsifying and dispersing machine "CAVITRON CD1010" (manufactured by EUROTEC LIMITED) at a transfer rate of 100 parts by mass per minute as it was in a molten state. Dilute aqueous ammonia which was prepared by diluting 70 parts by mass of reagent aqueous ammonia with ion-exchanged water in an aqueous solvent tank so as to have a concentration of 0.37% by mass was transferred to the emulsifying and dispersing machine at a transfer rate of 0.1 liter per minute while heating to 100° C. using a heat exchanger at the same time with the transfer of this hybrid crystalline polyester resin A in a molten state. Thereafter, an aqueous dispersion (A) of the fine particles of the hybrid crystalline polyester resin A having a solid content of 30 parts by mass was prepared by running this emulsifying and dispersing machine under the condition of a rotational speed of the rotor of 60 Hz and a pressure of 5 $kg/cm^2$. At this time, the particles of the hybrid crystalline polyester resin A contained in the dispersion (A) had a median diameter on a volume basis of 200 nm.

Production Examples 2 to 11: Preparation of Aqueous Dispersions (B) to (K) of Fine Particles of Hybrid Crystalline Polyester Resins B to K The aqueous dispersions (B) to (K) of the hybrid crystalline polyester resin fine particles were prepared, respectively, in the same manner as in the Production Example 1 above except that the hybrid crystalline polyester resins B to K obtained in the Synthesis Examples 2 to 11 above were used instead of the hybrid crystalline polyester resin A. At this time, the particles contained in the dispersions (B) to (K) had a median diameter on a volume basis within a range of from 100 to 500 nm.

Production Example 12: Preparation of Aqueous Dispersion (L) of Fine Particles of Crystalline Polyester Resin L The aqueous dispersion (L) of the crystalline polyester resin was prepared in the same manner as in the Production Example 1 above except that the crystalline polyester resin (1) (crystalline polyester resin L) obtained in the Synthesis Example 10 above was used as it was instead of the hybrid crystalline polyester resin A. At this time, the particles contained in the dispersion liquid (L) had a median diameter on a volume basis of 140 nm.

Production Example 13: Preparation of Aqueous Dispersion (X) of Fine Particles of Amorphous Resin X <<First Stage Polymerization>>

In a 5 L separable reaction vessel equipped with a stirring device, a temperature sensor, a cooling tube, and a nitrogen introducing device, a surfactant solution prepared by dissolving 8 parts by mass of an anionic surfactant (sodium dodecyl sulfonate: SDS) in 3000 parts by mass of ion-exchanged water was put, and the internal temperature of the reaction vessel was raised to 80° C. while stirring at a speed of 230 rpm in a nitrogen stream. After the temperature was raised, an initiator solution prepared by dissolving 10 parts by mass of a polymerization initiator (potassium persulfate: KPS) in 200 parts by mass of ion-exchanged water was added thereto, the liquid temperature was raised to 80° C. again, and a monomer mixed liquid composed of:

| | |
|---|---|
| Styrene | 532 parts by mass |
| n-butyl acrylate | 200 parts by mass and |
| Methacrylic acid | 68 parts by mass |

was added thereto dropwise over 1 hour. This system was heated and stirred for 2 hours at 80° C. to conduct the polymerization (first stage polymerization), thereby preparing the dispersion (x1) of the resin fine particles.

<<Second Stage Polymerization>>

In a 5 L reaction vessel equipped with a stirring device, a temperature sensor, a cooling tube, and a nitrogen introducing device, a solution prepared by dissolving 7 parts by mass of sodium polyoxyethylene dodecyl ether sulfate in 3000 parts by mass of ion-exchanged water was put and heated to 98° C., and 260 parts by mass of the dispersion (x1) of the resin fine particles and a solution prepared by dissolving monomers and a releasing agent composed of

| | |
|---|---|
| Styrene | 278 parts by mass |
| n-butyl acrylate | 91 parts by mass |
| Methacrylic acid | 19 parts by mass |
| n-octyl-3-mercaptopropionate | 1.5 parts by mass and |
| Releasing agent: behenyl behenate (melting point: 73° C.) | 190 parts by mass |

at 90° C. was added thereto, and the mixture was mixed and dispersed for 1 hour using a mechanical dispersing machine with a circulation path "CLEARMIX (registered trademark)" (manufactured by M Technique Co., Ltd.) thereby preparing a dispersion containing emulsified particles (oil droplets).

Subsequently, an initiator solution prepared by dissolving 6 parts by mass of potassium persulfate in 200 parts by mass of ion-exchanged water was added to this dispersion, and this system was heated and stirred for 1 hour at 84° C. to conduct the polymerization, thereby preparing the dispersion (x2) of the resin fine particles.

<<Third Stage Polymerization>>

Furthermore, a solution prepared by dissolving 11 parts by mass of potassium persulfate in 400 parts by mass of ion-exchanged water was added to the dispersion (x2) of the resin fine particles, and a monomer mixed liquid composed of

| | |
|---|---|
| Styrene | 378 parts by mass |
| n-butyl acrylate | 144 parts by mass |
| Methacrylic acid | 36 parts by mass |
| Methyl methacrylate | 42 parts by mass and |
| n-octyl-3-mercaptopropionate | 8 parts by mass |

was added thereto dropwise over 1 hour at a temperature condition of 82° C. After the dropwise addition was ended, the mixture was heated and stirred for 2 hours to conduct the polymerization, the resultant was then cooled to 28° C., thereby preparing the aqueous dispersion (X1) of the fine particles of the amorphous resin X composed of a vinyl resin.

With regard to the aqueous dispersion (X1) of the fine particles of the amorphous resin X thus obtained, the median diameter on a volume basis of the fine particles of the amorphous resin X was 210 nm, the glass transition temperature (Tg) was 51° C., and the weight average molecular weight (Mw) was 31,000.

Production Example 14: Preparation of Aqueous Dispersion (A1) of Fine Particles of Hybrid Amorphous Polyester Resin A The following raw material monomer of the addition polymerization-based resin (styrene-acrylic resin: StAc) unit, the following amphoterically reactive monomer, and the following radical polymerization initiator were put in a dropping funnel.

| | |
|---|---|
| Styrene | 80 parts by mass |
| n-butyl acrylate | 20 parts by mass |
| Acrylic acid | 10 parts by mass and |
| Polymerization initiator (di-t-butyl peroxide) | 16 parts by mass |

In addition, the following raw material monomer of a polycondensation-based resin (amorphous polyester resin: APEs) unit was put in a four-necked flask equipped with a nitrogen inlet tube, a dehydrating tube, a stirrer, and a thermocouple and dissolved by heating to 170° C.

| | |
|---|---|
| Bisphenol A propylene oxide (2 mol) adduct | 285.7 parts by mass |
| Terephthalic acid | 66.9 parts by mass and |
| Fumaric acid | 47.4 parts by mass |

Subsequently, the raw material monomer of the addition polymerization-based resin was added thereto dropwise over 90 minutes under stirring, the resultant was aged for 60 minutes, and the unreacted addition polymerization monomer was then removed therefrom under reduced pressure (8 kPa). Thereafter, 0.4 part by mass of $Ti(OBu)_4$ as an esterification catalyst was put therein, the temperature thereof was raised up to 235° C., and the reaction thereof was conducted for 5 hours at the atmospheric pressure (101.3 kPa) and further for 1 hour under reduced pressure (8 kPa).

Next, the resultant was cooled to 200° C. and the reaction was then conducted under reduced pressure (20 kPa). Subsequently, the solvent was removed, thereby obtaining the hybrid amorphous polyester resin A as a resin for shell. With regard to the hybrid amorphous polyester resin A thus obtained, the glass transition temperature (Tg) was 60° C. and the weight average molecular weight (Mw) was 53,000.

In 400 parts by mass of ethyl acetate (manufactured by KANTO CHEMICAL CO., INC.), 100 parts by mass of the hybrid amorphous polyester resin A thus obtained was dissolved, the solution was mixed with 638 parts by mass of sodium lauryl sulfate solution which was prepared in advance so as to have a concentration of 0.26% by mass, and the mixture was ultrasonically dispersed for 30 minutes at the V-LEVEL of 300 μA using an ultrasonic homogenizer "US-150T" (manufactured by NISSEI Corporation) while stirring. Thereafter, ethyl acetate was completely removed from the resultant in a state of being warmed to 40° using a diaphragm vacuum pump "V-700" (manufactured by BUCHI Labortechnik AG) while stirring for 3 hours under reduced pressure, thereby preparing the aqueous dispersion (A1) of the fine particles of the hybrid amorphous polyester resin A having a solid content of 13.5% by mass. At this time, the fine particles of the hybrid amorphous polyester resin A contained in the dispersion (A1) had a median diameter on a volume basis of 160 nm.

Production Examples 15 and 16: Preparation of Aqueous Dispersions (B1) and (C1) of Fine Particles of Hybrid Amorphous Polyester Resins B and C The aqueous dispersions (B1) and (C1) of the fine particles of the hybrid amorphous polyester resins B and C were obtained in the same manner as in the Production Example 14 above except that the added amount of the raw material monomer of the polycondensation-based resin (APEs) was changed so that the proportion of the addition polymerization-based resin (StAc) unit contained in the hybrid amorphous polyester resin became the values presented in Table 2. Incidentally, at this time, the composition ratio of the raw material monomer and the added amount of the raw material monomer of the addition polymerization-based resin (StAc) and the composition ratio of the raw material monomer of the polycondensation-based resin (APEs) were set to be the same as those in the Production Example 14 above. The weight average molecular weights (Mw) of the hybrid amorphous polyester resins B and C are presented in Table 2, respectively.

Production Examples 17 to 19: Preparation of Aqueous Dispersions (D1) to (F1) of Fine Particles of Hybrid Amorphous Polyester Resins D to F The aqueous dispersions (D1) to (F1) of the fine particles of the hybrid amorphous polyester resins D to F were prepared in the same manner as in the Production Example 14 above except that the kind and the added amount of the raw material monomer of the polycondensation-based resin (APEs) unit were changed as follows, respectively. Incidentally, at this time, the composition ratio of the raw material monomer and the added amount of the raw material monomer of the addition polymerization-based resin (StAc) were set to be the same as those in the Production Example 14 above. The weight average molecular weights (Mw) of the hybrid amorphous polyester resins D to F are presented in Table 2, respectively.

<<Hybrid Amorphous Polyester Resin D>>

| | |
|---|---|
| Terephthalic acid | 58.1 parts by mass |
| Fumaric acid | 40.6 parts by mass and |
| Trimellitic acid | 37.8 parts by mass |

<<Hybrid Amorphous Polyester Resin E>>

| | |
|---|---|
| Terephthalic acid | 66.9 parts by mass and |
| Succinic acid | 47.6 parts by mass |

<<Hybrid Amorphous Polyester Resin F>>

| | |
|---|---|
| Isophthalic acid | 67.0 parts by mass and |
| Fumaric acid | 47.4 parts by mass |

Production Examples 20 and 21: Preparation of Aqueous Dispersions (G1) and (H1) of Fine Particles of Hybrid Amorphous Polyester Resins G and H The aqueous dispersions (G1) and (H1) of the fine particles of the hybrid amorphous polyester resins G and H were obtained in the same manner as in the Production Example 14 above except that the added amount of the raw material monomer of the polycondensation-based resin (APEs) was changed so that the proportion of the addition polymerization-based resin (StAc) unit contained in the hybrid amorphous polyester resin became the values presented in Table 2. Incidentally, at this time, the composition ratio of the raw material monomer and the added amount of the raw material monomer of the addition polymerization-based resin (StAc) and the composition ratio of the raw material monomer of the polycondensation-based resin (APEs) were set to be the same as those in the Production Example 14 above. The weight average molecular weights (Mw) of the hybrid amorphous polyester resins G and H are presented in Table 2, respectively.

Production Example 22: Preparation of Aqueous Dispersion (I1) of Fine Particles of Hybrid Amorphous Polyester Resin I The aqueous dispersion (I1) of the fine particles of the hybrid amorphous polyester resin I was prepared in the same manner as in the Production Example 14 above except that the hybrid amorphous polyester resin I was obtained by the following procedure.

The following raw material monomer of an addition polymerization-based resin (styrene-acrylic resin: StAc) unit containing an amphoterically reactive monomer and the following radical polymerization initiator were put in a dropping funnel.

| | |
|---|---|
| Styrene | 80 parts by mass |
| n-butyl acrylate | 20 parts by mass |
| Acrylic acid | 10 parts by mass |
| Polymerization initiator (di-t-butyl peroxide) | 16 parts by mass |

Subsequently, the raw material monomer of the addition polymerization-based resin (StAc) unit was added dropwise over 90 minutes under stirring, the resultant was aged for 60 minutes, and the unreacted addition polymerization monomer was then removed therefrom under reduced pressure (8 kPa), thereby obtaining the vinyl resin (2). Incidentally, the amount of the monomer that was removed at this time was a significantly small amount as compared to the ratio of the raw material monomer of the resin.

Separately, 66.9 parts by mass of terephthalic acid, 47.4 parts by mass of fumaric acid, and 285.7 parts by mass of bisphenol A propylene oxide (2 mol) adduct were put in a reaction vessel equipped with a stirrer, a thermometer, a cooling tube, and a nitrogen gas inlet tube. The inside of the reaction vessel was purged with dry nitrogen gas, 0.1 part by mass of $Ti(OBu)_4$ was then added thereto, and the reaction thereof was conducted for 8 hours at about 180° C. in a nitrogen gas stream while stirring. Thereto, 0.2 part by mass of $Ti(OBu)_4$ was further added, the temperature thereof was raised up to about 220° C., and the reaction thereof was conducted for 6 hours while stirring, the internal pressure of the reaction vessel was then reduced to 1.33 kPa (10 mmHg), and the reaction was conducted under reduced pressure, thereby obtaining the amorphous polyester resin (1). The weight average molecular weight (Mw) of the amorphous polyester resin (1) was 41,000.

The vinyl resin (2) obtained above was graft-polymerized to the amorphous polyester resin (1) by the following procedure, thereby synthesizing the hybrid amorphous polyester resin I having a graft structure in which the amorphous polyester resin (APEs) was the main chain and the vinyl resin (StAc) was the side chain.

First, 80 parts by mass of the amorphous polyester resin (1) and 20 parts by mass of the vinyl resin (2) were dissolved in 100 parts by mass of toluene, and the solution was put in a flask equipped with a cooling tube and then heated for 5 hours at 120° C. in a nitrogen stream to conduct the polymerization reaction.

Next, the polymer was taken out by dissolving in THF and reprecipitated by being added dropwise to methanol, the precipitate was then filtered, further washed with methanol repeatedly, and then subjected to vacuum drying at 40° C., thereby obtaining the hybrid amorphous polyester resin I. The weight average molecular weight (Mw) of the hybrid amorphous polyester resin I was 46,000.

Production Example 23: Preparation of Aqueous Dispersion (J1) of Fine Particles of Hybrid Amorphous Polyester Resin J The aqueous dispersion (J1) of the fine particles of the hybrid amorphous polyester resin J was prepared in the same manner as in the Production Example 14 above except that the hybrid amorphous polyester resin J was obtained by block-copolymerizing the vinyl resin (2) and the amorphous polyester resin (1) which were obtained in the Production Example 22 above by the following procedure.

First, 80 parts by mass of the amorphous polyester resin (1) and 20 parts by mass of the vinyl resin (2) were put in a glass vessel equipped with a reflux cooling tube, a nitrogen inlet tube, and a stirrer, and dissolved by stirring at 50° C., 2.7 parts by mass of dicyclohexylcarbodiimide (DCC) and 0.17 part by mass of dimethylaminopyridine (DMAP) were added thereto, and the reaction thereof was conducted for 2 hours at 50° C., thereby obtaining the hybrid amorphous polyester resin J of a block copolymer of a vinyl resin and an amorphous polyester resin. The weight average molecular weight (Mw) of the hybrid amorphous polyester resin J was 67,000.

Production Example 24: Preparation of Aqueous Dispersion (K1) of Fine Particles of Amorphous Polyester Resin K The aqueous dispersion (K1) of the fine particles of the amorphous polyester resin K was prepared in the same manner as in the Production Example 14 above except that the amorphous polyester resin (1) (amorphous polyester resin K) obtained in the Production Example 23 above was used instead of the hybrid amorphous polyester resin A. At this time, the particles of the amorphous polyester resin (1) contained in the dispersion (K1) had a median diameter on a volume basis of 180 nm. In addition, the weight average molecular weight (Mw) of the amorphous polyester resin K was 49,000.

With regard to the aqueous dispersion (Cy1) of the colorant particles thus obtained, the median diameter on a volume basis of the colorant particles was 110 nm.

Production Example 26: Preparation of Releasing Agent Particle Dispersion Liquid (W)

A solution prepared by mixing 60 parts by mass of behenyl behenate (melting point: 73° C.) as a releasing agent, 5 parts by mass of an ionic surfactant "NEOGEN RK" (manufactured by DKS Co., Ltd.), and 240 parts by mass of ion-exchanged water was heated to 95° C., thoroughly dispersed using a homogenizer "ULTRA-TURRAX (registered trademark) T50" (manufactured by IKA), and then subjected to the dispersion treatment using a pressure discharge type Gaulin homogenizer, thereby preparing the releasing agent particle dispersion (W) having a solid content of 20 parts by mass. The median diameter on a volume basis of the particles in this releasing agent particle dispersion was 240 nm.

TABLE 2

| | Weight average molecular weight (Mw) | Amorphous polyester resin unit | | | | Unit other than amorphous polyester resin | | |
|---|---|---|---|---|---|---|---|---|
| | | Polycarboxylic acid 1 | Polycarboxylic acid 2 | Polycarboxylic acid 3 | Diol | Kind | Ratio (% by mass) | Structure |
| Hybrid amorphous polyester resin A | 53,000 | Terephthalic acid | Fumaric acid | — | Bisphenol A propylene oxide | StAc resin | 20 | Amorphous polyester resin is grafted to StAc resin |
| Hybrid amorphous polyester resin B | 36,000 | Terephthalic acid | Fumaric acid | — | Bisphenol A propylene oxide | StAc resin | 5 | Amorphous polyester resin is grafted to StAc resin |
| Hybrid amorphous polyester resin C | 16,000 | Terephthalic acid | Fumaric acid | — | Bisphenol A propylene oxide | StAc resin | 30 | Amorphous polyester resin is grafted to StAc resin |
| Hybrid amorphous polyester resin D | 24,000 | Terephthalic acid | Fumaric acid | Trimellitic acid | Bisphenol A propylene oxide | StAc resin | 20 | Amorphous polyester resin is grafted to StAc resin |
| Hybrid amorphous polyester resin E | 33,000 | Terephthalic acid | — | Succinic acid | Bisphenol A propylene oxide | StAc resin | 20 | Amorphous polyester resin is grafted to StAc resin |
| Hybrid amorphous polyester resin F | 51,000 | Isophthalic acid | Fumaric acid | — | Bisphenol A propylene oxide | StAc resin | 20 | Amorphous polyester resin is grafted to StAc resin |
| Hybrid amorphous polyester resin G | 62,000 | Terephthalic acid | Fumaric acid | — | Bisphenol A propylene oxide | StAc resin | 4 | Amorphous polyester resin is grafted to StAc resin |
| Hybrid amorphous polyester resin H | 34,000 | Terephthalic acid | Fumaric acid | — | Bisphenol A propylene oxide | StAc resin | 31 | Amorphous polyester resin is grafted to StAc resin |
| Hybrid amorphous polyester resin I | 46,000 | Terephthalic acid | Fumaric acid | — | Bisphenol A propylene oxide | StAc resin | 20 | StAc resin is grafted to amorphous polyester resin |
| Hybrid amorphous polyester resin J | 67,000 | Terephthalic acid | Fumaric acid | — | Bisphenol A propylene oxide | StAc resin | 20 | Straight-chain block polymer of StAc resin and amorphous polyester resin |
| Amorphous polyester resin K | 49,000 | Terephthalic acid | Fumaric acid | — | Bisphenol A propylene oxide | StAc resin | — | — |

Production Example 25: Preparation of Aqueous Dispersion of Colorant Particles (Cy1)

To 1600 parts by mass of ion-exchanged water, 90 parts by mass of sodium n-dodecyl sulfate was added. To this solution, 420 parts by mass of copper phthalocyanine (C. I. Pigment Blue 15:3) was gradually added to this solution while stirring, the mixture was then subjected to the dispersion treatment using a stirring device "CLEAR MIX (registered trademark)" (manufactured by M Technique Co., Ltd.), thereby preparing the aqueous dispersion (Cy1) of the colorant particles.

Example 1: Production of Cyan Toner (1) and Developer 1

In a reaction vessel equipped with a stirring device, a temperature sensor, a cooling tube, and a nitrogen introducing device, 349 parts by mass (in terms of solid content) of the aqueous dispersion (X1) of fine particles of the amorphous resin X, 56 parts by mass (in terms of solid content)

of the aqueous dispersion (A) of the fine particles of the hybrid crystalline polyester resin A, and 2,000 parts by mass of ion-exchanged water were put, the pH thereof was adjusted to 10 by adding an aqueous solution of sodium hydroxide having a concentration of 25% by mass.

Thereafter, 32 parts by mass (in terms of solid content) of the aqueous dispersion (Cy1) of the colorant particles was put therein, an aqueous solution prepared by dissolving 60 parts by mass of magnesium chloride in 60 parts by mass of ion-exchanged water was then added thereto over 10 minutes at 30° C. under stirring. Thereafter, the mixture was left to stand for 3 minutes, the temperature thereof was then started to be raised, this system was heated up to 80° C. over 60 minutes, and the particle growth reaction was continued while the temperature was held at 80° C. In this state, the median diameter on a volume basis of the associated particles was measured using the "COULTER Multisizer 3" (manufactured by Beckman Coulter, Inc.), and 45 parts by mass (in terms of solid content) of the aqueous dispersion (A1) of the fine particles of the hybrid amorphous polyester resin A for shell was put therein over 30 minutes at the time point at which the median diameter on a volume basis became 6.0 μm. The particle growth was stopped as an aqueous solution prepared by dissolving 190 parts by mass of sodium chloride in 760 parts by mass of ion-exchanged water was added thereto at the time point at which the supernatant of the reaction mixture became transparent. Furthermore, the temperature was raised, the resultant was heated and stirred in a state of being at 90° C. to conduct the fusion of the particles, and the resultant was cooled to 30° C. at a cooling rate of 2.5° C./min at a time point at which the average circularity measured using a device for measuring the average circularity of toner "FPIA-2100" (manufactured by Sysmex Corporation) became 0.945.

The dispersion of colored particles obtained in this manner was subjected to the solid-liquid separation using a basket-type centrifuge "MARK III, model number 60×40" (manufactured by MATSUMOTO MACHINE MFG CO., LTD.), thereby forming a wet cake. This wet cake was repeatedly subjected to the washing and the solid-liquid separation until the electric conductivity of the filtrate from the basket-type centrifuge became 5 μS/cm, then subjected to the drying treatment by blowing a stream having a temperature of 40° C. and a humidity of 20% RH using the "flash jet dryer" (manufactured by SEISHIN ENTERPRISE Co., Ltd.) until the water content became 0.5% by mass, and cooled to 24° C., thereby obtaining the toner particles (1) having a median diameter on a volume basis of 6.0 μm.

To 100 parts by mass of the toner particles (1) thus obtained, 0.6 part by mass of hydrophobic silica (number average primary particle size=12 nm, hydrophobicity=68) and 1.0 part by mass of hydrophobic titanium oxide (number average primary particle size=20 nm, hydrophobicity=63) were added, the mixture was mixed for 20 minutes at 32° C. and a peripheral speed of the rotor blades of 35 mm/sec using the "Henschel mixer" (manufactured by MITSUI MIIKE MACHINERY Co., Ltd.) and subjected to the external additive treatment to remove coarse particles using a sieve having a mesh opening of 45 μm, thereby preparing the cyan toner (1).

A ferrite carrier which was coated with a silicone resin and had a median diameter on a volume basis of 60 μm was added to and mixed with the cyan toner (1) so as to have a toner concentration of 6% by mass, thereby producing the developer 1.

Examples 2 to 11: Production of Cyan Toners (2) to (11) and Developers 2 to 11

The cyan toners (2) to (11) and the developers 2 to 11 were produced in the same manner as in the Example 1 except that the aqueous dispersions (B) to (K) of the fine particles of the hybrid crystalline polyester resins B to K were used, respectively, instead of the aqueous dispersion (A) of the fine particles of the hybrid crystalline polyester resin A.

Examples 12 to 20: Production of Cyan Toners (12) to (20) and Developers 12 to 20

The cyan toners (12) to (20) and the developers 12 to 20 were produced in the same manner as in the Example 1 except that the aqueous dispersions (B1) to (J1) of the fine particles of the hybrid amorphous polyester resins B to J were used, respectively, instead of the aqueous dispersion (A1) of the fine particles of the hybrid amorphous polyester resin A.

Examples 21 and 22: Production of Cyan Toners (21) and (22) and Developers 21 and 22

The cyan toners (21) and (22) and the developers 21 and 22 were produced in the same manner as in the Example 1 except that the added amount of the respective dispersions was changed so that the ratios of the hybrid crystalline polyester resin and the hybrid amorphous polyester resin contained in the binder resin became the values presented in Table 1.

Example 23: Production of Cyan Toner (23) and Developer 23)

The cyan toner (23) and the developer 23 were produced, respectively, in the same manner as in the Example 1 except that the third stage polymerization of the amorphous resin X in the binder resin was changed as follows.

<<Third Stage Polymerization>>

Furthermore, a solution prepared by dissolving 11 parts by mass of potassium persulfate in 400 parts by mass of ion-exchanged water was added to the dispersion of the resin fine particles, and a monomer mixed liquid composed of:

| | |
|---|---|
| Styrene | 324 parts by mass |
| n-butyl acrylate | 150 parts by mass |
| Methacrylic acid | 90 parts by mass |
| Methyl methacrylate | 36 parts by mass and |
| n-octyl-3-mercaptopropionate | 8 parts by mass |

was added to the mixture dropwise over 1 hour at a temperature condition of 82° C. After the dropwise addition was ended, the resultant was heated and stirred for 2 hours to conduct the polymerization, the resultant was then cooled to 28° C., thereby preparing an aqueous dispersion of the fine particles of the amorphous resin composed of a vinyl resin.

With regard to the aqueous dispersion of the fine particles of the amorphous resin thus obtained, the median diameter on a volume basis of the fine particles of the amorphous resin was 200 nm, the glass transition temperature (Tg) was 52° C., and the weight average molecular weight (Mw) was 32,000.

Comparative Example 1: Production of Cyan Toner (24) and Developer 24

The cyan toner (24) and the developer 24 were produced, respectively, in the same manner as in the Example 1 except that the aqueous dispersion (L) of the fine particles of the crystalline polyester resin L was used instead of the aqueous dispersion (A) of the fine particles of the hybrid crystalline polyester resin A.

Comparative Example 2: Production of Cyan Toner (25) and Developer 25

The cyan toner (25) and the developer 25 were produced, respectively, in the same manner as in the Example 1 except that the aqueous dispersion (K1) of the fine particles of the amorphous polyester resin K was used instead of the aqueous dispersion (A1) of the fine particles of the hybrid amorphous polyester resin A.

Comparative Example 3: Production of Cyan Toner (26) and Developer 26

The cyan toner (26) and the developer 26 were produced, respectively, in the same manner as in the Example 1 except that the aqueous dispersion (L1) of the fine particles of the crystalline polyester resin L was used instead of the aqueous dispersion (A) of the fine particles of the hybrid crystalline polyester resin A and the aqueous dispersion (K1) of the fine particles of the amorphous polyester resin K was used instead of the aqueous dispersion (A1) of the fine particles of the hybrid amorphous polyester resin A.

<Evaluation Method>

Low Temperature Fixability (Fixability when Folded)

The developer was filled in a full-color copying machine "bizhub (registered trademark) PRO C6501" (manufactured by Konica Minolta, Inc.) of a commercially available hybrid printer equipped with a fixing device which had been modified so that the surface temperature of the heat roller for fixing was able to change in a range of from 100 to 210° C., and the fixing experiment to fix a solid image on A4-size plain paper (basis weight: 80 g/m$^2$) having a toner amount attached of 11 mg/10 cm$^2$ was repeatedly conducted while changing the fixing temperature to be set such that the fixing temperature was increased by 5° C. from 100° C. to 105° C., . . . . Subsequently, the printed materials obtained in the fixing experiment for each fixing temperature was folded so as to apply a load to the solid image using a folding machine, compressed air at 0.35 MPa was blown to this, the crease was ranked in 5 stages according to the following evaluation criteria, and the fixing temperature in the fixing experiment having the lowest fixing temperature among the fixing experiments which were ranked to 3 was evaluated as the lower limit fixing temperature. ⊙ to Δ are judged to be acceptable.

<Evaluation Criteria>

Rank 5: entirely no crease

Rank 4: partly peeled off along crease

Rank 3: peeled off in fine lines along crease

Rank 2: peeled off in thick lines along crease

Rank 1: greatly peeled off

⊙: fixing temperature of 100° C. or higher and lower than 110° C.

○: fixing temperature of 110° C. or higher and lower than 120° C.

Δ: fixing temperature of 120° C. or higher and lower than 130° C.

x: fixing temperature of 130° C. or higher (Heat-Resistant Storage Property)

Into a 10 ml glass bottle with an inner diameter of 21 mm, 2 g of the toner was taken, the lid was put thereon, the bottle was shaken 600 times at room temperature using the TAP-DENSER KYT-2000 (manufactured by SEISHIN ENTERPRISE Co., Ltd.) and left to stand for 24 hours in an environment of 50° C. and 80% RH in a state that the lid was taken off. Subsequently, the toner was placed on the sieve having 48 meshes (mesh opening: 350 μm) while paying attention so as not to crush the toner aggregate, set in a powder tester (manufactured by HOSOKAWA MICRON CORPORATION), and immobilized with the pressing bar and the knob nut, the vibration intensity was adjusted so as to have a sending width of 1 mm, vibration was applied to the toner for 10 seconds, and the ratio (% by mass) of the toner amount remaining on the sieve was measured. The toner aggregation rate is the value calculated by the following Mathematical Formula. ⊙ to Δ are judged to be acceptable.

[Mathematical Formula 3]

$$\text{Toner aggregation rate (\%)}=\{\text{Mass of toner remaining on sieve (g)}/0.5\text{ (g)}\}\times 100$$

The heat-resistant storage property of the toner was evaluated according to the following criteria and the result was adopted as the indicator of the storage property.

⊙: toner aggregation rate of less than 10% by mass (toner exhibiting significantly favorable heat-resistant storage property)

○: toner aggregation rate of 10% by mass or more and less than 15% by mass (toner exhibiting favorable heat-resistant storage property)

Δ: toner aggregation rate of 15% by mass or more and less than 20% by mass (toner exhibiting slightly inferior heat-resistant storage property but being in an acceptable level)

x: toner aggregation rate of 20% by mass or more (toner exhibiting poor heat-resistant storage property and thus being unusable)

(Halftone Reproducibility (Charging Uniformity))

The charging uniformity was evaluated by the halftone reproducibility. The halftone chart was copied by the copying machine described above, the image density of this image was measured at 5 points in the axial direction of the photoreceptor and evaluated. Meanwhile, the image density was measured using an image densitometer (Macbeth RD914). The evaluation criteria are as follows. ⊙ to Δ are judged to be acceptable.

<<Evaluation Criteria>>

⊙: variation in concentration of less than 10% to be significantly favorable

○: variation in concentration of 10% or more and less than 15% to be favorable

Δ: variations in concentration of 15% or more and less than 20% x: variation in concentration of 20% or more (Evaluation on HH (High Temperature and High Humidity) Transferability)

An image having an image density of 1.30 (20 mm×50 mm) was formed after subjecting the copying machine described above to printing 100,000 times in a high temperature and high humidity environment (30° C. and 85% RH atmosphere), and the transfer rate was determined by the following Mathematical Formula and evaluated. ⊙ to Δ are judged to be acceptable.

[Mathematical Formula 4]

Transfer rate (%)={Mass of toner transferred on transferred material (g)/Mass of toner developed on photoreceptor (g)}×100

⊙: transfer rate of 95% or more

○: transfer rate of 90% or more and less than 95%

Δ: transfer rate of 85% or more and less than 90% x: transfer rate of less than 85%

The structures and evaluation results of Examples and Comparative Examples are presented in Table 3. Incidentally, in Table 3, the term "resin amount" represents the content of the hybrid crystalline resin or the hybrid amorphous resin with respect to the entire binder resin. In addition, in Table 3, the term "hybrid ratio" represents the content of the amorphous resin unit other than a polyester resin in the hybrid crystalline resin or the hybrid amorphous resin.

TABLE 3

| | Resin for core, hybrid crystalline resin | | | | Resin for shell, hybrid amorphous resin | | | | Evaluation results Low temperature |
|---|---|---|---|---|---|---|---|---|---|
| | Kind | Resin amount (% by mass) | Hybrid ratio (% by mass) | SP value $(cal/cm^3)^{1/2}$ | Kind | Resin amount (% by mass) | Hybrid ratio (% by mass) | SP value $(cal/cm^3)^{1/2}$ | fixability Measured value (° C.) |
| Example 1 | A | 12.5 | 10 | 10.23 | A | 10.0 | 20 | 10.90 | 105 |
| Example 2 | B | 12.5 | 5 | 10.23 | A | 10.0 | 20 | 10.90 | 115 |
| Example 3 | C | 12.5 | 30 | 10.23 | A | 10.0 | 20 | 10.90 | 100 |
| Example 4 | D | 12.5 | 10 | 10.23 | A | 10.0 | 20 | 10.90 | 105 |
| Example 5 | E | 12.5 | 10 | 10.22 | A | 10.0 | 20 | 10.90 | 105 |
| Example 6 | F | 12.5 | 10 | 10.22 | A | 10.0 | 20 | 10.90 | 105 |
| Example 7 | G | 12.5 | 10 | 10.21 | A | 10.0 | 20 | 10.90 | 115 |
| Example 8 | H | 12.5 | 4 | 10.23 | A | 10.0 | 20 | 10.90 | 110 |
| Example 9 | I | 12.5 | 31 | 10.23 | A | 10.0 | 20 | 10.90 | 120 |
| Example 10 | J | 12.5 | 10 | 10.23 | A | 10.0 | 20 | 10.90 | 120 |
| Example 11 | K | 12.5 | 10 | 10.23 | A | 10.0 | 20 | 10.90 | 115 |
| Example 12 | A | 12.5 | 10 | 10.23 | B | 10.0 | 5 | 10.90 | 105 |
| Example 13 | A | 12.5 | 10 | 10.23 | C | 10.0 | 30 | 10.90 | 110 |
| Example 14 | A | 12.5 | 10 | 10.23 | D | 10.0 | 20 | 10.90 | 115 |
| Example 15 | A | 12.5 | 10 | 10.23 | E | 10.0 | 20 | 10.90 | 110 |
| Example 16 | A | 12.5 | 10 | 10.23 | F | 10.0 | 20 | 10.90 | 115 |
| Example 17 | A | 12.5 | 10 | 10.23 | G | 10.0 | 4 | 10.90 | 115 |
| Example 18 | A | 12.5 | 10 | 10.23 | H | 10.0 | 31 | 10.90 | 120 |
| Example 19 | A | 12.5 | 10 | 10.23 | I | 10.0 | 20 | 10.90 | 120 |
| Example 20 | A | 12.5 | 10 | 10.23 | J | 10.0 | 20 | 10.90 | 120 |
| Example 21 | A | 4.5 | 10 | 10.27 | A | 4.5 | 20 | 10.90 | 125 |
| Example 22 | A | 25.5 | 10 | 10.15 | A | 25.5 | 20 | 10.90 | 120 |
| Example 23 | A | 12.5 | 10 | 10.38 | A | 10 | 20 | 10.90 | 110 |

| | Evaluation results | | | | | | |
|---|---|---|---|---|---|---|---|
| | Low temperature | Heat-resistant storage property | | Halftone reproducibility | | HH transferability | |
| | fixability Evaluation | Measured value (%) | Evaluation | Measured value (%) | Evaluation | Measured value (%) | Evaluation |
| Example 1 | ⊙ | 7 | ⊙ | 8 | ⊙ | 97 | ⊙ |
| Example 2 | ○ | 12 | ○ | 11 | ○ | 92 | ○ |
| Example 3 | ⊙ | 4 | ⊙ | 5 | ⊙ | 95 | ⊙ |
| Example 4 | ⊙ | 5 | ⊙ | 6 | ⊙ | 96 | ⊙ |
| Example 5 | ⊙ | 5 | ⊙ | 5 | ⊙ | 95 | ⊙ |
| Example 6 | ⊙ | 4 | ⊙ | 6 | ⊙ | 95 | ⊙ |
| Example 7 | ○ | 3 | ⊙ | 4 | ⊙ | 96 | ⊙ |
| Example 8 | ○ | 17 | Δ | 15 | Δ | 88 | Δ |
| Example 9 | Δ | 14 | ○ | 13 | ○ | 92 | ○ |
| Example 10 | Δ | 17 | Δ | 18 | Δ | 89 | Δ |
| Example 11 | ○ | 13 | ○ | 19 | Δ | 87 | Δ |
| Example 12 | ⊙ | 14 | ○ | 12 | ○ | 93 | ○ |
| Example 13 | ○ | 12 | ○ | 12 | ○ | 91 | ○ |
| Example 14 | ○ | 7 | ⊙ | 9 | ⊙ | 96 | ⊙ |
| Example 15 | ○ | 12 | ○ | 13 | ○ | 93 | ○ |
| Example 16 | ○ | 9 | ⊙ | 8 | ⊙ | 95 | ⊙ |
| Example 17 | ○ | 19 | Δ | 18 | Δ | 87 | Δ |
| Example 18 | Δ | 16 | Δ | 17 | Δ | 89 | Δ |
| Example 19 | Δ | 18 | Δ | 17 | Δ | 87 | Δ |
| Example 20 | Δ | 14 | ○ | 18 | Δ | 86 | Δ |
| Example 21 | Δ | 19 | Δ | 19 | Δ | 88 | Δ |
| Example 22 | Δ | 12 | ○ | 18 | Δ | 86 | Δ |
| Example 23 | ○ | 18 | Δ | 12 | ○ | 94 | ○ |

TABLE 3-continued

| | Core portion, crystalline resin | | | | Shell portion, amorphous resin | | | | Evaluation results Low temperature |
|---|---|---|---|---|---|---|---|---|---|
| | Kind | Resin amount (% by mass) | Hybrid ratio (% by mass) | SP value $(cal/cm^3)^{1/2}$ | Kind | Resin amount (% by mass) | Hybrid ratio (% by mass) | SP value $(cal/cm^3)^{1/2}$ | fixability Measured value (° C.) |
| Comparative Example 1 | L | 12.5 | 0 | 10.23 | A | 10.0 | 20 | 10.90 | 120 |
| Comparative Example 2 | A | 12.5 | 10 | 10.23 | K | 10.0 | 0 | 10.90 | 115 |
| Comparative Example 3 | L | 12.5 | 0 | 10.23 | K | 10.0 | 0 | 10.90 | 125 |

| | Evaluation results | | | | | | |
|---|---|---|---|---|---|---|---|
| | Low temperature | Heat-resistant storage property | | Halftone reproducibility | | HH transferability | |
| | fixability Evaluation | Measured value (%) | Evaluation | Measured value (%) | Evaluation | Measured value (%) | Evaluation |
| Comparative Example 1 | Δ | 18 | Δ | 17 | Δ | 83 | X |
| Comparative Example 2 | ○ | 16 | Δ | 15 | Δ | 84 | X |
| Comparative Example 3 | Δ | 17 | Δ | 19 | Δ | 81 | X |

From the results of Table 3, results having an excellent balance among the low temperature fixability, the image storage property, the charging uniformity, and the HH transferability have been obtained in the case of using the toners of Examples.

On the other hand, it has been found that a balance among the low temperature fixability, the image storage property, the charging uniformity, and the HH transferability decreases in the case of using the toners of Comparative Examples in which a hybrid resin was not used at least in either of the core portion or the shell portion.

What is claimed is:

1. A toner for developing electrostatic charge image, comprising: a toner particle having a core-shell structure and a binder resin, wherein the binder resin comprises a hybrid crystalline polyester resin, a hybrid amorphous polyester resin, and an amorphous vinyl resin, the hybrid crystalline polyester resin is formed by chemical bonding between a crystalline polyester resin unit and an amorphous vinyl resin unit, the crystalline polyester unit is formed from a monomer composition comprising an aliphatic dicarboxylic acid having from 4 to 14 carbon atoms and an aliphatic diol having from to 14 carbon atoms through a condensation reaction, and the amorphous vinyl resin unit of the hybrid crystalline polyester resin is a styrene-acrylic resin unit, the hybrid amorphous polyester resin is formed by chemical bonding between an amorphous polyester resin unit and an amorphous vinyl resin unit, the amorphous polyester resin unit is formed from a monomer composition comprising an aromatic dicarboxylic acid and a diol selected from ethylene oxide adduct of bisphenol A or propylene oxide adduct of bisphenol A through a condensation reaction, and the amorphous vinyl resin unit of the hybrid amorphous polyester resin is a styrene-acrylic resin unit, the amorphous vinyl resin is a styrene-acrylic resin, the core contains the hybrid crystalline polyester resin and the amorphous vinyl resin, and the shell contains the hybrid amorphous polyester resin.

2. The toner for developing electrostatic charge image according to claim 1, wherein a content of the amorphous vinyl resin unit in the hybrid crystalline polyester resin is from 5 to 30% by mass with respect to a total amount of the hybrid crystalline resin.

3. The toner for developing electrostatic charge image according to claim 1, wherein a content of the hybrid crystalline polyester resin in the binder resin is from 10 to 50% by mass with respect to the entire binder resin.

4. The toner for developing an electrostatic charge image according to claim 1, wherein the hybrid crystalline polyester resin is a graft copolymer having the amorphous vinyl resin unit as a main chain and the crystalline polyester resin unit as a side chain.

5. The toner for developing an electrostatic charge image according to claim 1, wherein a content of the hybrid crystalline polyester resin in the binder resin is from 3 to 50% by mass with respect to the entire binder resin.

6. The toner for developing an electrostatic charge image according to claim 1, wherein a content of the amorphous vinyl resin in the binder resin is from 50 to 97% by mass with respect to the entire binder resin.

7. The toner for developing an electrostatic charge image according to claim 1, wherein a content of the hybrid amorphous polyester resin in the binder resin is from 3 to 50% by mass with respect to the entire binder resin.

8. The toner for developing electrostatic charge image according to claim 1, wherein a content of the crystalline polyester resin unit in the hybrid crystalline polyester resin is from 50 to 99.9% by mass with respect to a total amount of the hybrid crystalline polyester resin.

9. The toner for developing electrostatic charge image according to claim 1, wherein a content of the amorphous polyester resin unit in the hybrid amorphous polyester resin is from 50 to 99.9% by mass with respect to a total amount of the hybrid amorphous polyester resin.

10. The toner for developing electrostatic charge image according to claim 1, wherein the aromatic dicarboxylic acid is at least one of terephtalic acid or isophtalic acid.

* * * * *